United States Patent [19]

Ikegawa et al.

[11] Patent Number: 4,906,553

[45] Date of Patent: Mar. 6, 1990

[54] PROCESSING PROCESS FOR SILVER HALIDE BLACK AND WHITE PHOTOGRAPHIC MATERIALS

[75] Inventors: Akihiko Ikegawa; Minoru Yamada; Masaki Okazaki; Junji Nishigaki, all of Kanagawa, Japan

[73] Assignee: Fuji Photo Film Co., Ltd., Kanagawa, Japan

[21] Appl. No.: 347,852

[22] Filed: May 5, 1989

[30] Foreign Application Priority Data

| | | | |
|---|---|---|---|
| May 9, 1988 | [JP] | Japan | 63-112169 |
| Jun. 3, 1988 | [JP] | Japan | 63-136717 |
| Jan. 19, 1989 | [JP] | Japan | 64-10298 |
| Jan. 20, 1989 | [JP] | Japan | 64-11251 |

[51] Int. Cl.[4] ..... G03C 5/24

[52] U.S. Cl. ..... 430/401; 430/963; 430/436; 430/437; 430/440; 430/441; 430/375

[58] Field of Search ..... 430/401, 963, 436, 437, 430/440, 441

[56] References Cited

U.S. PATENT DOCUMENTS

| | | | |
|---|---|---|---|
| 3,380,828 | 4/1968 | Kitze et al. | 430/963 |
| 3,666,457 | 5/1972 | Youngquist et al. | 430/436 |
| 3,672,891 | 6/1972 | Wyand et al. | 430/436 |
| 3,672,896 | 6/1972 | Gabrielsen et al. | 430/436 |
| 4,775,612 | 10/1988 | Abe et al. | 430/375 |

OTHER PUBLICATIONS

Research Disclosure, vol. 207, No. 20733 (Jul. 1981).

*Primary Examiner*—Paul R. Michl
*Assistant Examiner*—Thomas R. Neville
*Attorney, Agent, or Firm*—Sughrue, Mion, Zinn, Macpeak & Seas

[57] ABSTRACT

A process for processing a silver halide black and white photographic material, which comprises processing, after imagewise exposing, a silver halide black and white photographic material spectrally sensitized by a sensitizing dye with a processing solution containing at least one compound satisfying the following condition 1 and/or a salt thereof in an amount of at least $5\times10^{-5}$ mol/liter;

Condition 1:

when 4 ml of an aqueous solution of $8.0\times10^{-2}$ mol/liter of the compound is added to a mixture of 2 ml of an aqueous solution of $4.0\times10^{-4}$ mol/liter of anhydro-5,5'-dichloro-9-ethyl-3,3'-bis(3-sulfopropyl)thiacarbocyanine hydroxide.pyridinium salt and 1 ml of an aqueous solution of $1.0\times10^{-1}$ mol/liter of potassium chloride and the resultant solution is diluted with water to 10 ml, the molecular extinction coefficient of the aqueous solution at 624 nm is not higher than $1.0\times10^{5}$.

8 Claims, 1 Drawing Sheet

FIGURE
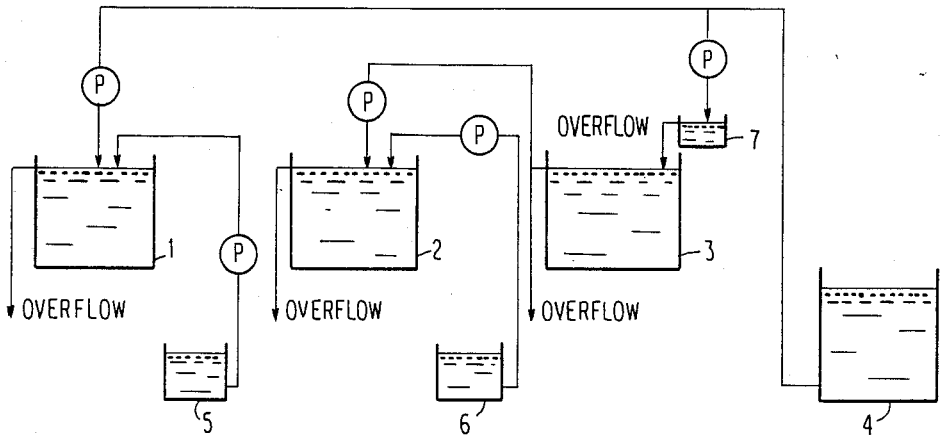

PROCESSING PROCESS FOR SILVER HALIDE BLACK AND WHITE PHOTOGRAPHIC MATERIALS

FIELD OF THE INVENTION

This invention relates to a processing process for silver halide black and white photographic materials for obtaining silver images, and more particularly to a processing process for silver halide black and white photographic materials giving less residual color and improved photographic properties.

BACKGROUND OF THE INVENTION

With the progress and development of the electronics field, quickness has been required in every field and the field of silver halide photographic processing is no exception.

In particular, in processing of sheet-form light-sensitive materials such as light-sensitive materials for graphic arts, X-ray photographic light-sensitive materials, light-sensitive materials for scanners, light-sensitive materials for CRT image recording, etc., the requirement for quick processing is constantly increasing.

Also, when processing is quickened, there is an advantage that the volume of a tank required for processing a unit amount of light-sensitive material for a unit time may be small, that is, the size of an automatic processor can be reduced, and hence the significance of quick processing becomes important.

However, quickening of development processing aggravates the problem that sensitizing dye(s) contained in silver halide light-sensitive materials leave color (so-called residual color) in the light-sensitive materials without being eluted out completely during processing and the problem that reductions in photographic performance (development inhibition, fix inhibition, bleach inhibition, etc.) occur with the delay of the desorption of sensitizing dye(s) from silver halide grains.

Hitherto, as a method of reducing the occurrence of residual color, various methods are described, e.g., in *Research Disclosure,* Vol. 207, No. 20733 (July, 981). That is, there are (1) a method of adding a water-soluble stilbene compound and/or a nonionic surface active agent to a developer, (2) a method of treating photographic elements with an oxidizing agent after developing, bleaching, and fixing, to destroy sensitizing dye(s) left in the elements, and (3) a method of employing a persulfuric acid bleach bath as the bleach bath. However, these methods are insufficient because when residual color is large, the methods do not positively accelerate the desorption and elution of sensitizing dye(s), and in particular, the methods are unsuitable for quick processing.

SUMMARY OF THE INVENTION

A first object of this invention is, therefore, to provide a process of quickly processing a silver halide black and white light-sensitive material sensitized by a sensitizing dye.

A second object of this invention is to provide a processing process for a black and white light-sensitive material capable of solving the problems of causing residual color and reducing the photographic performance by a sensitizing dye in quick processing The inventors have confirmed that the residual color in processing, in particular, quick processing of a silver halide black and white photographic material spectrally sensitized by as sensitizing dye is caused by the J band aggregate formed by the sensitizing dye existing in the photographic material, that is a sensitizing dye is liable to form a J band aggregate and the aggregate thus formed remains in the photographic material without being eluted out at processing to thereby cause residual color. Thus, as a result of various investigations, the inventors have discovered that the occurrence of residual color in the case of processing a silver halide black and white photographic material spectrally sensitized by a sensitizing dye by processing the photographic material with a processing solution containing at least one compound and/or a salt thereof, satisfying the condition that when an aqueous solution containing a specific amount of the compound is added to a mixture of an aqueous solution of anhydro-5,5'-dichloro-9-ethyl-3,3'-bis(3-sulfopropyl)-thiacarbocyanine hydroxide.-pyridinium salt at a specific concentration and a specific amount of potassium chloride, the molecular extinction coefficient of the aqueous solution at 624 nm is less than a specific value, can be remarkably inhibited. The inventors have succeeded in attaining the present invention based on this discovery.

The aforesaid pyridinium salt is a typical sensitizing dye and the dye is liable to form a J band aggregate, the adsorption of the aggregate appearing at 624 nm.

It has now been discovered in this invention that the compound thus selected has a remarkable effect of inhibiting the occurrence of residual color at almost all sensitizing dyes for photographic materials.

That is, the invention is a process for processing a silver halide black and white photographic material, which comprises processing, after imagewise exposing, a silver halide black and white photographic material spectrally sensitized by a sensitizing dye with a processing solution containing at least one compound satisfying the following condition 1 and/or a salt thereof;

Condition 1

When 4 ml of an aqueous solution of $8.0\times10^{-2}$ mol/-liter of the compound is added to a mixture of 2 ml of an aqueous solution of $4.0\times10^{4}$ mol/liter of anhydro-5,5'-dichloro-9-ethyl-3,3'-bis(3-sulfopropyl)thiacarbocyanine hydroxide.pyridinium salt and 1 ml of an aqueous solution of $1.0\times10^{-1}$ mol/liter of potassium chloride and the resultant solution is diluted with water to 10 ml, the molecular extinction coefficient of the aqueous solution at 624 nm is not higher than $1.0\times10^{5}$.

According to the processing process of this invention, the desorption and elution of sensitizing dye(s) existing in silver halide black and white photographic materials are accelerated, whereby the reduction of the photographic performance occurred by the delay of the desorption of the sensitizing dye(s) and the occurrence of residual color by the sensitizing dye(s) are restrained to levels of giving no problems.

BRIEF DESCRIPTION OF THE DRAWING

The FIGURE is a schematic view showing an embodiment of an automatic processor system which was used for practicing the processing process of this invention in Example 1 described herein below.

DETAILED DESCRIPTION OF THE INVENTION

The invention is described below in detail.

As the compounds satisfying the aforesaid condition 1, there are various kinds of compounds and in these compounds, cyclic compounds are preferred and the cyclic compounds having a molecular weight of not more than 600, and particularly not more than 500 are particularly preferred. However, in the case of compounds shown by formula (II), those having a molecular weight of not more than 1,000, particularly not more than 800, are preferred.

Also, the compounds are preferably water-soluble and compounds which are at least 0.4 g, and in particular at least 0.08 g soluble in 100 ml of water at 20° C. are more preferred.

Now, the preferred compounds satisfying the condition 1 are illustrated below.

(a) Compounds shown by formula (I)

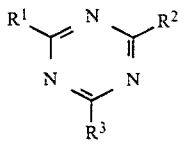

(I)

wherein $R^1$, $R^2$, and $R^3$, which may be the same or different, each represents a hydrogen atom, a halogen atom, —OM (wherein M represents a hydrogen atom (e.g., Cl, Br, I) or a monovalent metal such as Na, K, and Li), a substituted or unsubstituted alkyl group, a substituted or unsubstituted aryl group, a substituted or unsubstituted alkoxy group, a substituted or unsubstituted amino group, a sulfo group, a substituted or unsubstituted aryloxy group, a substituted or unsubstituted alkylthio group, a substituted or unsubstituted arylthio group, or a substituted or unsubstituted aminothiocarbonylthio group.

In particular, the alkyl group has preferably not more than 20 carbon atoms and examples thereof are methyl, ethyl, 2-hydroxyethyl, 2-diethylaminoethyl, propyl, isopropyl, 3-dimethylaminopropyl, pentyl, isopentyl, hexyl, cyclohexyl, heptyl, benzyl, and octadecyl. The aryl group has preferably not more than 15 carbon atoms and examples thereof are phenyl, tolyl, sulfophenyl, carboxyphenyl, naphthyl, and sulfonaphthyl. The alkoxy group has preferably not more than 20 carbon atoms and examples thereof are methoxy, ethoxy, propyloxy, butoxy, and octadecyloxy. The substituted amino group has preferably not more than 20 carbon atoms and examples thereof are dimethylamino, diethylamino, hydroxyamino, 2-hydroxyethylamino, 2-sulfoethylamino, 2-diethylaminoethylamino, anilino, and β-naphthylamino. The aryloxy group has preferably not more than 20 carbon atoms and examples thereof are phenoxy, 4-sulfophenoxy, and β-naphthyloxy. The alkylthio group has preferably not more than 20 carbon atoms and examples thereof are methylthio, ethylthio, 2-hydroxyethylthio, 2-diethylaminoethylthio, and dodecylthio. The arylthio group has preferably not more than 20 carbon atoms and examples thereof are phenylthio, β-naphthylthio, and 4-sulfophenylthio. Also, the substituted aminothiocarbonylthio group has preferably not more than 15 carbon atoms and examples thereof are dimethylaminothiocarbonylthio, diethylaminothiocarbonylthio, and phenylaminothiocarbonylthio.

(b) Compounds shown by formula (II)

$$A\text{-}(L)_n\text{-}B \qquad \text{(II)}$$

wherein A and B, which may be the same or different, each represents a substituted or unsubstituted heterocyclic residue, L represents a divalent linkage group, and n represents 0 or a positive integer.

As the heterocyclic residue shown by A and B, a 5-membered, 6-membered or 7-membered cyclic residue is preferred and these cyclic residues may form a condensed ring. Also, each cyclic residue may be substituted.

Examples of the divalent linkage group shown by L are an aliphatic divalent organic residue, an aromatic divalent organic residue, $$-\overset{\overset{\displaystyle R}{|}}{N}-$$

(wherein R represents a hydrogen atom, an alkyl group, or an aryl group), —O—, —S—, —Se—, or a divalent organic residue containing at least one of nitrogen atom, oxygen atom, sulfur atom, and selenium atom.

Examples of the heterocyclic residue shown by A and B are furyl, thienyl, pyrrolyl, triazinyl, triazolyl, imidazolyl, pyridyl, pyrimidinyl, pyrazinyl, quinazolyl, purinyl, quinolinyl, acrydinyl, indolyl, thiazolyl, oxazolyl, selenazolyl, furazanyl, and polycyclic heterocyclic residues formed by condensing a benzo condensed ring or a naphtho condensed ring to the aforesaid heterocyclic rings or by condensing the heterocyclic rings.

In the aforesaid heterocyclic residues, dicyclic or polycyclic heterocyclic residues are particularly preferred.

Examples of the organic residue as the linkage group shown by L are methylene, ethylene, phenylene, propylene, 1-oxo-2-butenyl-1,3-ene, p-xylene-α,α'-diyl, ethylenedioxy, succinyl, malonyl, $-CH_2SCH_2-$, $-CH_2OCH_2-$, and $-CH_2SeCH_2-$.

Also, n is preferably a positive integer of not larger than 5.

The alkyl group shown by R of formula $$-\overset{\overset{\displaystyle R}{|}}{N}-$$

has preferably not more than 10 carbon atoms and the aryl group shown by R has preferably not more than 20 carbon atoms.

Also, the compounds shown by formulae (I) and (II), which satisfy the aforesaid condition 1, may have forms of salts thereof with an inorganic or organic acid.

Preferred examples of the inorganic and organic acids are hydrochloric acid, sulfuric acid, nitric acid, hydrobromic acid, hydroiodic acid, perchloric acid, oxalic acid, p-toluenesulfonic acid, methanesulfonic acid, and trifluoromethanesulfonic acid.

(c) Compounds shown by formula (III)

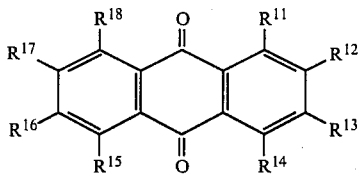

(III)

wherein $R^{11}$, $R_{12}$, $R^{13}$, $R^{14}$, $R^{15}$, $R^{16}$, $R^{17}$, and $R^{18}$, which may be the same or different, each represents a hydrogen atom, a halogen atom (e.g., Cl, Br, I), —OM (wherein M represents a hydrogen atom or a monovalent metal (e.g., Na, K, and Li), a substituted or unsubstituted alkyl group, a substituted or unsubstituted aryl group, a substituted or unsubstituted alkoxy group, a substituted or unsubstituted amino group, a cyano group, a nitro group, a sulfo group, a carboxyl group, a substituted or unsubstituted aryloxy group, a substituted or unsubstituted alkylthio group, a substituted or unsubstituted arylthio group, a substituted or unsubstituted acyl group, a substituted or unsubstituted aminosulfonyl group, a substituted or unsubstituted alkoxycarbonyl group, a substituted or unsubstituted aryloxycarbonyl group, or a substituted or unsubstituted aminocarbonyl group.

In particular, the aforesaid alkyl group has preferably not more than 20 carbon atoms and examples thereof are methyl, ethyl, 2-hydroxyethyl, 2-diethylaminoethyl, propyl, isopropyl, 3-dimethylaminopropyl, pentyl, isopentyl, hexyl, cyclohexyl, heptyl, benzyl, and octadecyl. The aryl group has preferably not more than 15 carbon atoms and examples thereof are phenyl, tolyl, sulfophenyl, carboxyphenyl, naphthyl, and sulfonaphthyl. The alkoxy group has preferably not more than 20 carbon atoms and examples thereof are methoxy, ethoxy, propyloxy, butoxy, and octadecyloxy. The substituted amino group has preferably not more than 20 carbon atoms and examples thereof are methylamino, diethylamino, hydroxyamino, 2-hydroxyethylamino, 2-sulfoethylamino, 2-diethylaminoethylamino, anilino, and β-naphthylamino. The aryloxy group has preferably not more than 20 carbon atoms and examples thereof are phenoxy, 4-sulfophenoxy, and β-naphthyloxy. The alkylthio group has preferably not more than 20 carbon atoms and examples thereof are methylthio, ethylthio, 2-hydroxyethylthio, 2-diethylaminoethylthio, and dodecylthio. The arylthio group has preferably not more than 20 carbon atoms and examples thereof are phenylthio, β-naphthylthio, and 4-sulfophenylthio. The acyl group has preferably not more than 20 carbon atoms and examples thereof are acetyl, propionyl, butyryl, stearoyl, and benzoyl. The substituted aminosulfonyl group has preferably not more than 20 carbon atoms and examples thereof are diethylaminosulfonyl, di(2-hydroxyethyl)-aminosulfonyl, anilinosulfonyl, 2-sulfoethylaminocarbonyl, and dodecylaminosulfonyl. The alkoxycarbonyl group has preferably not more than 20 carbon atoms and examples thereof are methoxycarbonyl, ethoxycarbonyl, methoxyethoxycarbonyl, diethylaminoethoxycarbonyl, and benzyloxycarbonyl. The aryloxycarbonyl group has preferably not more than 20 carbon atoms and examples thereof are phenoxycarbonyl, 4-sulfophenyloxycarbonyl, and tolyloxycarbonyl. Also, the substituted aminocarbonyl group has preferably not more than 20 carbon atoms and examples thereof are dimethylaminocarbonyl, diethylaminocarbonyl, propylaminocarbonyl, octadecylaminocarbonyl, and 2-sulfoethylaminocarbonyl.

(d) Compound shown by formula (IV)

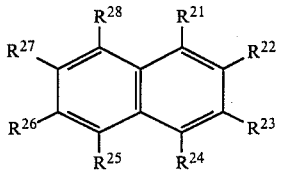

(IV)

wherein $R^{21}$, $R^{22}$, $R^{23}$, $R^{24}$, $R^{25}$, $R^{26}$, $R^{27}$, and $R^{28}$, which may be the same or different, each represents a hydrogen atom, a halogen atom (e.g., Cl, Br, I), —OM (wherein M represents a hydrogen atom or a monovalent metal (e.g., Na, K, and Li), a substituted or unsubstituted alkyl group, a substituted or unsubstituted aryl group, a substituted or unsubstituted alkoxy group, a substituted or unsubstituted amino group, a mercapto group, a cyano group, a nitro group, a sulfo group, a carboxyl group, a substituted or unsubstituted aryloxy group, a substituted or unsubstituted alkylthio group, a substituted or unsubstituted arylthio group, a substituted or unsubstituted acyl group, a substituted or unsubstituted aminosulfonyl group, a substituted or unsubstituted alkoxycarbonyl group, a substituted or unsubstituted aryloxycarbonyl group, or a substituted or unsubstituted aminocarbonyl group. Furthermore, said $R^{21}$ and $R^{22}$, said $R^{22}$ and $R^{23}$, said $R^{23}$ and $R^{24}$, said $R^{24}$ and $R^{25}$, said $R^{25}$ and $R^{26}$, said $R^{26}$ and $R^{27}$, or said $R^{27}$ and $R^{28}$ may form a substituted or unsubstituted condensed benzene ring (e.g., anthracene ring).

In particular, the aforesaid alkyl group has preferably not more than 20 carbon atoms and examples thereof are methyl, ethyl, 2-hydroxyethyl, 2-diethylaminoethyl, propyl, isopropyl, 3-dimethylaminopropyl, pentyl, isopentyl, hexyl, cyclohexyl, heptyl, benzyl, and octadecyl. The aryl group has preferably not more than 15 carbon atoms and examples thereof are phenyl, tolyl, sulfophenyl, carboxyphenyl, naphthyl, and sulfonaphthyl. The alkoxy group has preferably not more than 20 carbon atoms and examples thereof are methoxy, ethoxy, propyloxy, butoxy, and octadecyloxy. The substituted amino group has preferably not more than 20 carbon atoms and examples thereof are dimethylamino, diethylamino, hydroxyamino, 2-hydroxyethylamino, 2-sulfoethylamino, 2-diethylaminoethylamino, anilino, and β-naphthylamino. The aryloxy group has preferably not more than 20 carbon atoms and examples thereof are phenoxy, 4-sulfophenoxy, and β-naphthyloxy. The alkylthio group has preferably not more than 20 carbon atoms and examples thereof are methylthio, ethylthio, 2hydroxyethylthio, 2-diethylaminoethylthio, and dodecylthio. The arylthio group has preferably not more than 20 carbon atoms and examples thereof are phenylthio, β-naphthylthio, and 4-sulfophenylthio. The acyl group has preferably not more than 20 carbon atoms and examples thereof are acetyl, propionyl, butyryl, stearoyl, and benzyl. The substituted aminosulfonyl group has preferably not more than 20 carbon atoms and examples thereof are diethylaminosulfonyl, di(2-hydroxyethyl)aminosulfonyl, anilinosulfonyl, 2-sulfoethylaminocarbonyl, and dodecylaminosulfonyl. The alkoxycarbonyl group has preferably not more than 20 carbon atoms and examples thereof are methoxycarbonyl, ethoxycarbonyl, methoxyethoxycarbonyl, diethylaminoethoxycarbonyl, and benzyloxycarbonyl. The aryloxycarbonyl group has preferably not more than 20 carbon atoms and examples thereof are phenoxycarbonyl, 4-sulfophenoxycarbonyl, and tolyloxycarbonyl. Also, the substituted aminocarbonyl group has preferably not more than 20 carbon atoms and examples thereof are dimethylaminocarbonyl, diethylaminocarbonyl, propylaminocarbonyl, octadecylaminocarbonyl, and 2-sulfoethylaminocarbonyl.

Also, the compounds shown by aforesaid formulae (III) and (IV), which satisfy the condition 1, may have forms of salts thereof with an inorganic or organic acid.

Preferred examples of the inorganic and organic acids are hydrochloric acid, sulfuric acid, nitric acid, hydrobromic acid, hydroiodic acid, perchloric acid, oxalic acid, p-toluenesulfonic acid, methanesulfonic acid, and trifluoromethanesulfonic acid.

(e) Di- to tetra-cyclic heterocyclic compounds satisfying the condition 1. Examples thereof are compounds having at least one of oxygen atom, nitrogen atom, sulfur atom, selenium atom, and tellurium atom as the ring-constituting atom.

Preferred examples of the di- to tetra-cyclic heterocyclic rings are benzothiazole, benzoxazole, benzoselenazole, benzotellurazole, benzimidazole, indole, isoindole, indolenine, indoline, indazole, chromene, chroman, isochroman, quinoline, isoquinoline, quinolidine, cinnoline, phthalazine, quinazoline, quinoxaline, naphthyridine, purine, pteridine, indolizine, benzofuran, isobenzofuran, benzothiophene, benzopyran, benzazepine, benzoxazine, cyclopentapyran, cycloheptaisoxazole, benzothiazepine, pyrazolotriazole, tetraazaindene, naphthothiazole, naphthoxazole, naphthoselenazole, naphthotellurazole, naphthimidazole, carbazole, xanthene, phenanthridine, acridine, perimidine, phenanthroline, thianthrene, phenoxthine, phenoxazine, phenothiazine, phenazine, and polycyclic compounds formed by the condensation of the aforesaid heterocyclic rings and a cyclic hydrocaron such as benzene, naphthalene, etc., or a heterocyclic ring such as furan, thiophene, pyrrole, pyran, thiopyran, pyridine, oxazole, isoxazole, thiazole, isothiazole, imidazole, pyrozole, pyrazine, pyrimidine, pyridazine, etc.

The hererocyclic compounds (e) having the following cyclic rings are particularly preferred.

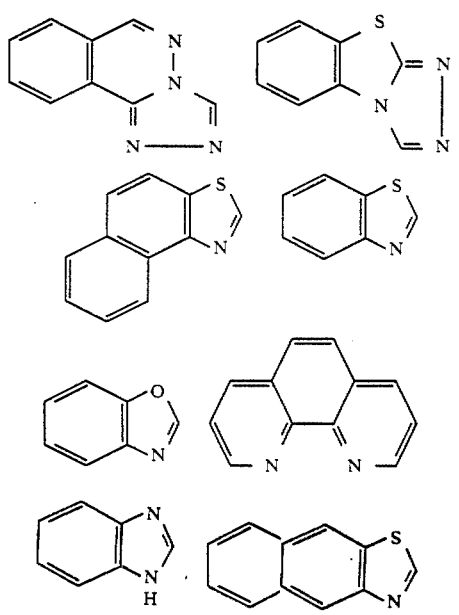

-continued

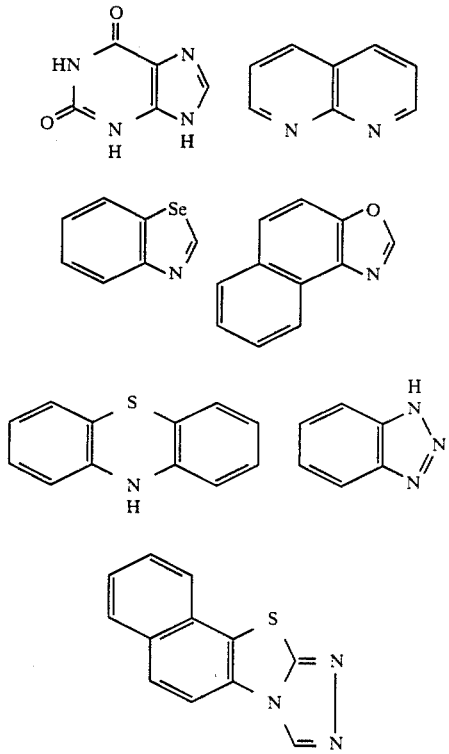

Also, these polycyclic compounds may have a substituent and preferred examples of the substituent are a halogen atom (e.g., Cl, Br, I), —OM (wherein M represents a hydrogen atom or a monovalent metal such as Na, K, and Li), a substituted or unsubstituted alkyl group, a substituted or unsubstituted aryl group, a substituted or unsubstituted alkoxy group, a substituted or unsubstituted amino group, a cyano group, a nitro group, a sulfo group, a carboxyl group, a substituted or unsubstituted aryloxy group, a substituted or unsubstituted alkylthio group, a substituted or unsubstituted arylthio group, a substituted or unsubstituted acyl group, a substituted or unsubstituted aminosulfonyl group, a substituted or unsubstituted alkoxycarbonyl group, a substituted or unsubstituted aryloxycarbonyl group, and a substituted or unsubstituted aminocarbonyl group.

In particular, the aforesaid alkyl group has preferably not more than 20 carbon atoms and examples thereof are methyl, ethyl, 2-hydroxyethyl, 2-diethylaminoethyl, propyl, isopropyl, 3-dimethylaminopropyl, pentyl, isopentyl, hexyl, cyclohexyl, heptyl, benzyl, and octadecyl. The aryl group has preferably not more than 15 carbon atoms and examples thereof are phenyl, tolyl, sulfophenyl, carboxyphenyl, naphthyl, and sulfonaphthyl. The alkoxy group has preferably not more than 20 carbon atoms and examples thereof are methoxy, ethoxy, propyloxy, butoxy, and octadecyloxy. The substituted amino group has preferably not more than 20 carbon atoms and examples thereof are dimethylamino, diethylamino, hydroxyamino, 2-hydroxyethylamino, 2-sulfoethylamino, 2-diethylaminoethylamino, anilino, and β-naphthylamino. The aryloxy group has preferably not more than 20 carbon atoms and examples thereof are phenoxy, 4-sulfophenoxy, and β-naphthyloxy. The alkylthio group has preferably not more than 20 carbon atoms and examples thereof are methylthio, ethylthio, 2-hydroxyethylthio, 2-diethylaminoethylthio, dodecylthio, 2-sulfoethylthio, 3-sulfopropylthio, and 4-sulfobutylthio. The arylthio group has preferably not more than 20 carbon atoms and examples thereof are phenylthio, β-naphthylthio, and 4-sulfophenylthio. The acyl group has preferably not more than 20 carbon atoms and examples thereof are acetyl, propionyl, butyryl, stearoyl, and benzoyl. The substituted aminosulfonyl group has preferably not more than 20 carbon atoms and examples thereof are diethylaminosulfonyl, di(2-hydroxyethyl)aminosulfonyl, anilinosulfonyl, 2-sulfoethylaminocarbonyl, and dodecylaminosulfonyl. The alkoxycarbonyl group has preferably not more than 20 carbon atoms and examples thereof are methoxycarbonyl, ethoxycarbonyl, methoxyethoxycarbonyl, diethylaminoethoxycarbonyl, and benzyloxycarbonyl. The aryloxycarbonyl group has preferably not more than 20 carbon atoms and examples thereof are phenoxycarbonyl, 4-sulfophenyloxycarbonyl, and tolyloxycarbonyl. Also, the substituted aminocarbonyl group has preferably not more than 20 carbon atoms and examples thereof are dimethylaminocarbonyl, diethylaminocarbonyl, propylaminocarbonyl, octadecylaminocarbonyl, and 2-sulfoethylaminocarbonyl.

Also, the aforesaid polycyclic compounds may be in the forms of salts thereof with an inorganic or organic acid. Preferred examples of the inorganic and organic acids are hydrochloric acid, sulfuric acid, nitric acid, hydrobromic acid, hydroiodic acid, perchloric acid, oxalic acid, p-toluenesulfonic acid, methanesulfonic acid, and trifluoromethanesulfonic acid.

(f) In the compounds (e) satisfying the aforesaid condition 1, tricyclic or tetracyclic heterocyclic compounds capable of being adsorbed onto silver halide.

As the tricyclic or tetracyclic heterocyclic compounds capable of being adsorbed onto silver halide, the compounds shown by the following formulae (f-I), (f-II) or (f-III) are preferred.

(f-I)

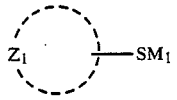

wherein $Z_1$ represents an atomic group necessary for forming a tricyclic or tetracyclic heterocyclic ring, and $M_1$ represents a hydrogen atom or a counter cation.

It is preferred that —$SM_1$ of formula (f-I) is bonded to a carbon atom of $Z_1$.

Preferred examples of the tricyclic or tetracyclic heterocyclic ring formed by $Z_1$ are a saturated or unsaturated pyrrole ring, imidazole ring, triazole ring, thiadiazole ring, tetrazole ring, thiazole ring, isothiazole ring, pyrazole ring, oxazole ring, isoxazole ring, selenazole ring, pyridine ring, pyrimidine ring, pyridazine ring, triazine ring, quinoxaline ring, tetraazaindene ring, oxadiazole ring, selenadiazole ring, indazole ring, triazaindene ring, tellurazole ring, indole ring, isoindole ring, indolenine ring, chromene ring, chroman ring, quinoline ring, isoquinoline ring, quinolizine ring, cinnoline ring, phthalazine ring, quinazoline ring, naphthyridine ring, purine ring, pteridine ring, indolizine ring, furan ring, thiophene ring, pyran ring, zepine ring oxazine ring, thiazepine ring, carbazole ring, xanthene ring, phenanthridine ring, acridine ring, pyrimidine ring, phenanthroline ring, thianthrene ring, phenoxthine ring, phenoxazine ring, phenothiazine ring, phenazine ring, benzene ring, naphthalene ring, anthracene ring, and rings formed by condensing these rings with each other.

$M_1$ of formula (f-I) is a hydrogen atom or a counter cation such as an alkali metal (e.g., sodium and potassium) or a conjugate acid of an organic base (e.g., triethylamine, pyridine, and DBU (1,8-diazabicyclo-[5,4,0]-7-undecene).

(f-II)

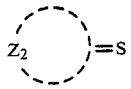

wherein $Z_2$ has the same meaning as $Z_1$ in formula (f-I) exclusive of the structure that the thioxo group can be enolizated by tautomerism. It is preferred that in formula (f-II), =S is bonded to a carbon atom of $Z_2$.

(f-III)

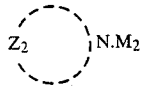

wherein $Z_3$ represents an atomic group necessary for forming the compound capable of forming imino silver in the tricyclic or tetracyclic heterocyclic compound formed by $Z_1$. $M_2$ has the same meaning as $M_1$.

In this invention, the compounds having the following heterocyclic rings are preferred.

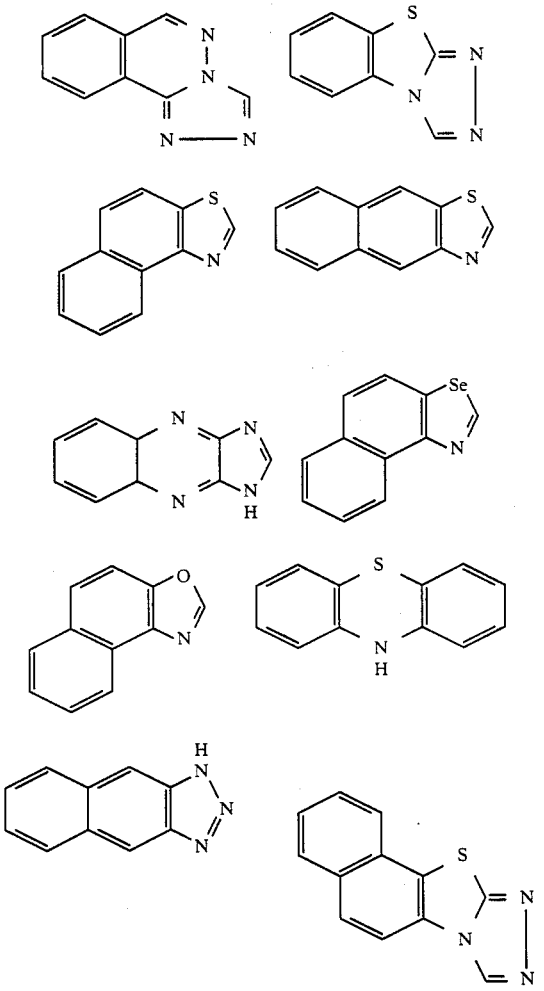

-continued

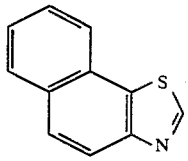

Also, these polycyclic compounds may have substituents and preferred examples thereof are a halogen atom (e.g., Cl, Br, I), —OM (wherein M represents a hydrogen atom or a monovalent metal such as Na, K, and Li), a substituted or unsubstituted alkyl group, a substituted or unsubstituted aryl group, a subtituted or unsubstituted alkoxy group, a substituted or unsubstituted amino group, a cyano group, a nitro group, a sulfo group, a carboxyl group, a substituted or unsubstituted aryloxy group, a substituted or unsubstituted arylthio group, a substituted or unsubstituted acyl group, a substituted or unsubstituted aminosulfonyl group, a substituted or unsubstituted alkoxycarbonyl group, a substituted or unsubstituted aryloxycarbonyl group, and a substituted or unsubstituted aminocarbonyl group.

In particular, the alkyl group has preferably not more than 20 carbon atoms and examples thereof are methyl, ethyl, 2-hydroxyethyl, 2-diethylaminoethyl, propyl, isopropyl, 3-dimethylaminopropyl, pentyl, isopentyl, hexyl, cyclohexyl, heptyl, benzyl, and octadecyl. The aryl group has preferably not more than 15 carbon atoms and examples thereof are phenyl, tolyl, sulfophenyl, carboxyphenyl, naphthyl, and sulfonaphthyl. The alkoxy group has preferably not more than 20 carbon atoms and examples thereof are methoxy, ethoxy, propyloxy, butoxy, and octadecyloxy. The substituted amino group has preferably not more than 20 carbon atoms and examples thereof are dimethylamino, diethylamino, hydroxyamino, 2-hydroxyethylamino, 2-sulfoethylamino, 2-diethylaminoethylamino, anilino, and β-naphthylamino. The aryloxy group has preferably not more than 20 carbon atoms and examples thereof are phenoxy, 4-sulfophenoxy, and β-naphthyloxy. The alkylthio group has preferably not more than 20 carbon atoms and examples thereof are methylthio, ethylthio, 2-hydroxyethylthio, 2-diethylaminoethylthio, dodecylthio, 2-sulfoethylthio, 3-sulfopropylthio, and 4-sulfobutylthio. The arylthio group has preferably not more than 20 carbon atoms and examples thereof are phenylthio, β-naphthylthio, and 4-sulfophenylthio. The acyl group has preferably not more than 20 carbon atoms and examples thereof are acetyl, propionyl, butyryl, stearoyl, and benzoyl. The substituted aminosulfonyl group has preferably not more than 20 carbon atoms and examples thereof are diethylaminosulfonyl, di(2-hydroxyethyl)aminosulfonyl, anilinosulfonyl, 2-sulfoethylaminocarbonyl, and dodecylaminosulfonyl. The alkoxycarbonyl group has preferably not more than 20 carbon atoms and examples thereof are methoxycarbonyl, ethoxycarbonyl, methoxyethoxycarbonyl, diethylaminoethoxycarbonyl, and benzyloxycarbonyl. The aryloxycarbonyl group has preferably not more than 20 carbon atoms and examples thereof are phenoxycarbonyl, 4-sulfophenyloxycarbonyl, and tolyloxycarbonyl. Also, the substituted aminocarbonyl group has preferably not more than 20 carbon atoms and examples thereof are dimethylaminocaronyl, diethylaminocarbonyl, propylaminocarbonyl, octadecylaminocarbonyl, and 2-sulfoethylaminocarbonyl.

Also, the aforesaid polycyclic compounds may be in the forms of salts with an inorganic or organic acid. Preferred examples of the inorganic or organic acids are hydrochloric acid, sulfuric acid, nitric acid, hydrobromic acid, hydroiodic acid, perchloric acid, oxalic acid, p-toluenesulfonic acid, methanesulfonic acid, and trifluorosulfonic acid.

Then, specific examples of the compounds satisfying the aforesaid condition 1 are illustrated but the invention is not limited to them.

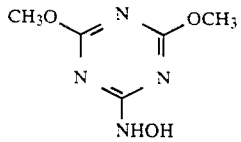

(1)

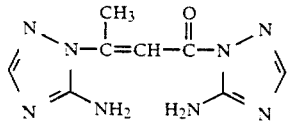

(2)

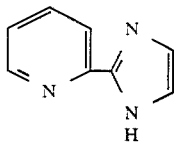

(3)

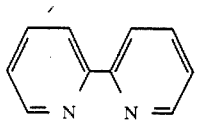

(4)

-continued
(5)
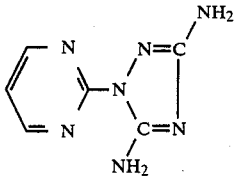
(6)
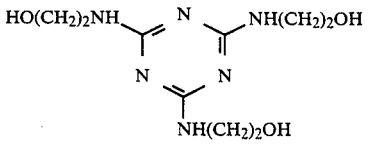
(7)
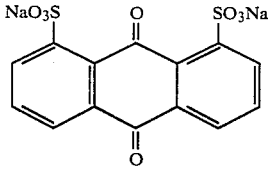
(8)
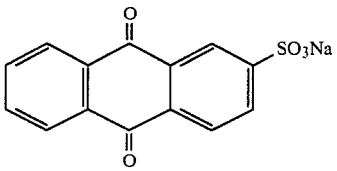
(9)
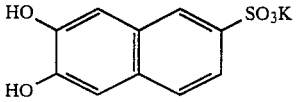
(10)
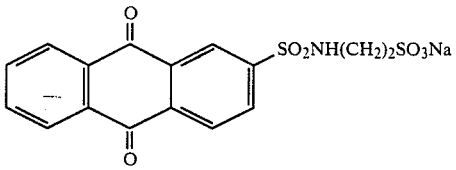
(11)
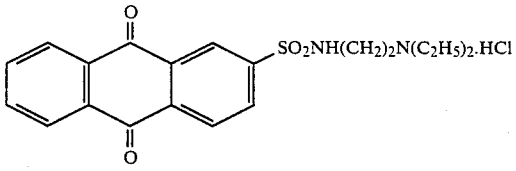
(12)
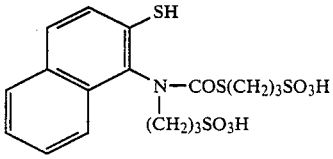
(13)
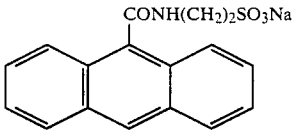
(14)
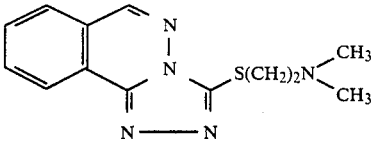

-continued
(15)
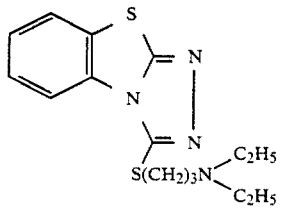
(16)
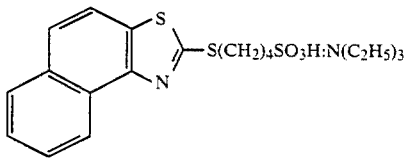
(17)
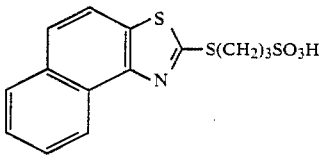
(18)
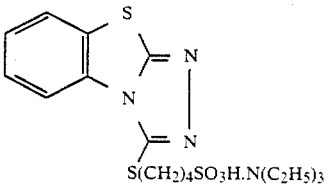
(19)
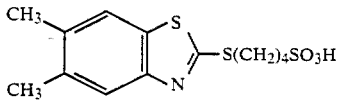
(20)
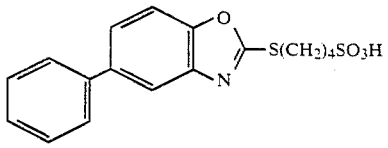
(21)
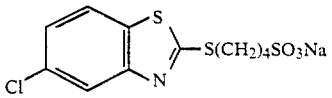
(22)
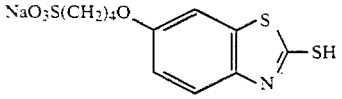
(23)
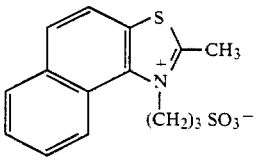

-continued
(24)
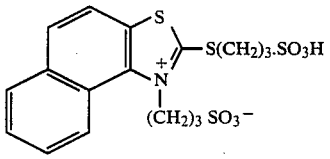
(25)
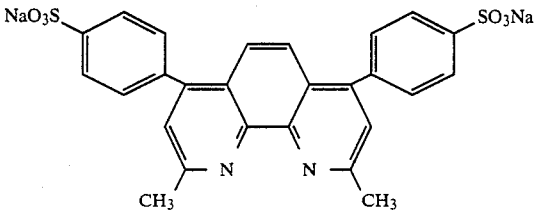
(26)
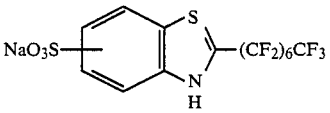
(27)
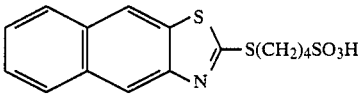
(28)
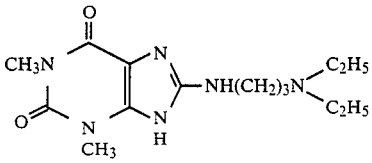
(29)
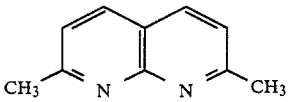
(30)
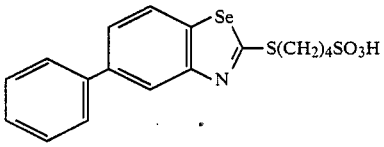
(31)
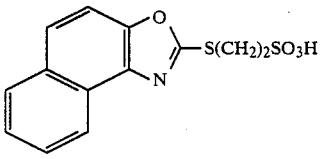
(32)
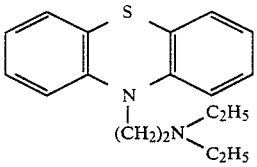
(33)
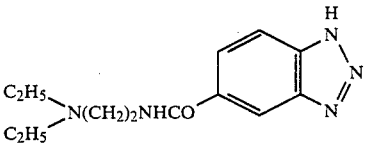

-continued
(34)
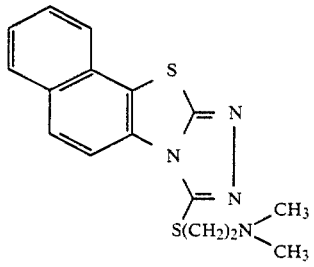
(35)
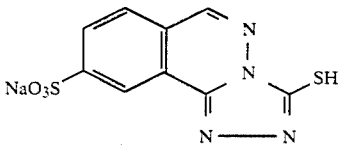
(36)
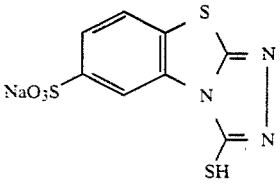
(37)
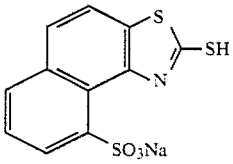
(38)
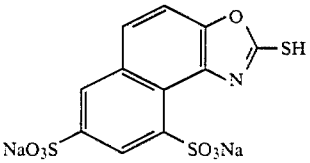
(39)
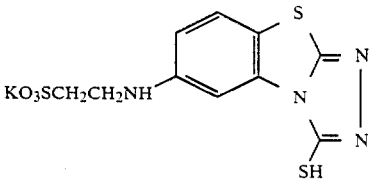
(40)
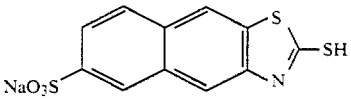
(41)
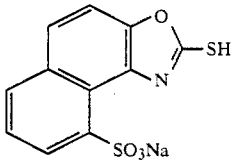

-continued
(42)
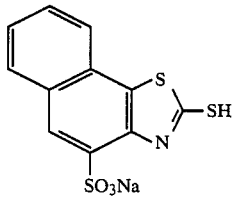
(43)
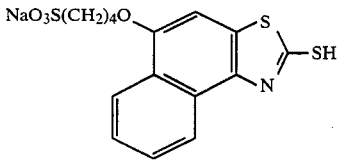
(44)
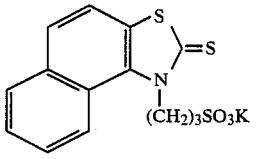
(45)
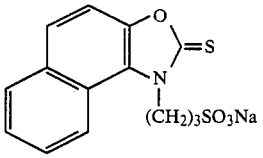
(46)
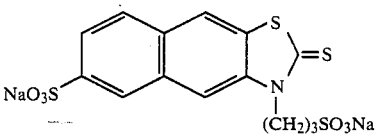
(47)
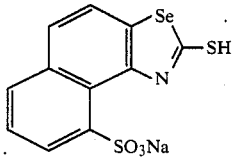
(48)
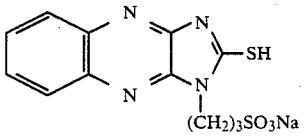
(49)
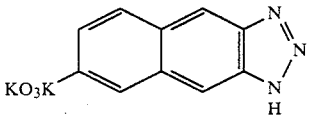
(50)
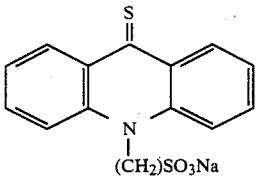

-continued
(51)
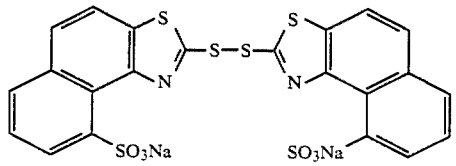
(52)
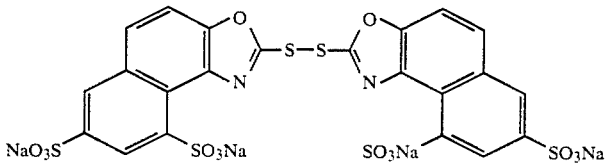
(53)
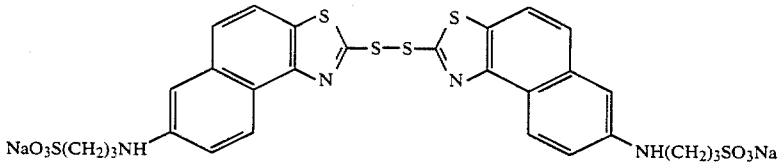
(54)
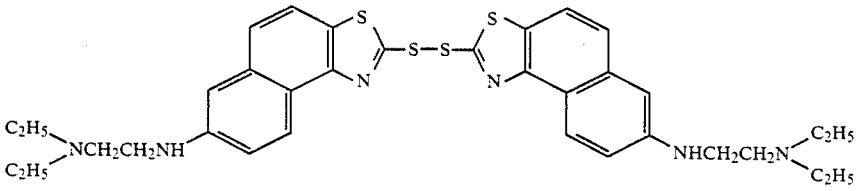
(55)
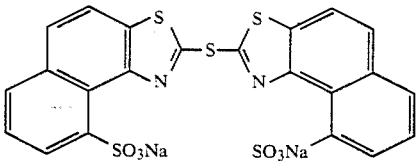
(56)
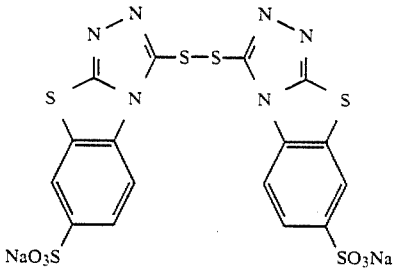
(57)
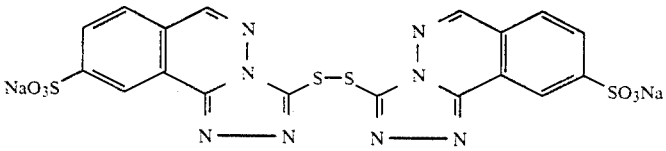
(58)
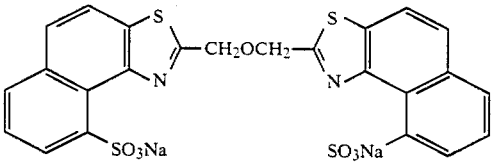

-continued (59)

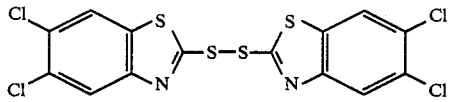

(60)

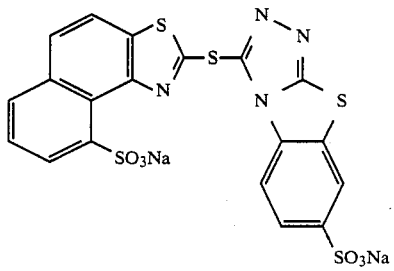

When in the aqueous solution obtained in the condition 1 described above using each of the compounds illustrated above, the molecular extinction coefficient of the solution at 624 nm was measured, the molecular extinction coefficient of the solution using Compound (1) was $0.17\times10^5$, that of the solution using Compound (2) was $0.20\times10^5$, that of the solution using Compound (6) was $0.03\times10^5$, and the molecular extinction coefficients in the cases of other compounds were 0.

Many of the compounds satisfying the condition 1 are commercially available or can be easily produced from commercially available compounds.

For example, specific compounds illustrated above can be synthesized by the synthetic methods described in Smolin and Rapopori, *Heterocyclic Compounds-s-Triazine and Derivatives,* Interscience Publishers (1959), Temple, *Heterocyclic Compounds-Triazine* 1,2,4, John Wiley & Sons (1981), Hoffmann, *Heterocyclic Compounds-Imidazole and Derivatives,* (1953), Metzger, *Heterocyclic Compounds, Thiazole and Its Derivatives,* John Wiley & Sons (1979), and Klinsberg, *Heterocyclic Compounds-Pyridine and Derivatives,* Interscience Publishers (1960). Also, some of the compounds or precursors thereof are commercially available.

The processing process of this invention is fundamentally composed of the steps of developing an imagewise exposed silver halide black and white photographic material, fixing it, washing (or stabilizing) it, and drying.

The compound satisfying the aforesaid condition 1 in this invention may be added to the developer, the fix solution, the wash solution (or stabilization solution), or the pre-bath of each of the processing solutions but is preferably added to the fix solution or the wash solution (or stabilization solution), and is particularly preferably added to the fix solution, whereby the object of this invention can be most effectively attained.

The addition amount of the compound satisfying the condition 1 in this invention to the processing solution is from $5\times10^{-5}$ mol/liter to $10^{-1}$ mol/liter, preferably from $10^{-4}$ mol/liter to $5\times10^{-2}$ mol/liter, and more preferably from $3\times10^{-3}$ mol/liter to $10^{-2}$ mol/liter.

If the addition amount is less than the aforesaid range, the effect of reducing residual color is not obtained, and if the amount is over the aforesaid range, the compound precipitates in the processing solution and such a large amount of the compound increases the cost for the processing.

As the developing agent for the developer which is used for the processing process of this invention, a combination of a dihydroxybenzene and a 3-pyrazolidone is most preferred from the standpoint of easily obtaining good performance but, as a matter of course, the developer may further contain a p-aminophenol series developing agent.

As the dihydroxybenzene developing agent for use in this invention, there are hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone, and hydroquinone is particularly preferred.

As the p-aminophenol series developing agent for use in this invention, there are N-methyl-p-aminophenol, p-aminophenol, N-(α-hydroxyethyl)-p-aminophenol, N-(4-hydroxyphenyl)glycine, 2-methyl-p-aminophenol, and p-benzylaminophenol, and of these compounds, N-methyl-p-aminophenol is preferred.

As the 3-pyrazolidone series developing agent for use in this invention, there are 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

The developing agent is preferably used in an amount of from 0.001 mol/liter to 1.2 mols/liter.

For the processing process of this invention, sulfites can be used as preservatives and as such sulfites, there are sodium sulfite, potassium sulfite, lithium sulfite, ammonium sulfite, sodium hydrogensulfite, and potassium metahydrogensulfite. The sulfite is used in an amount of at least 0.2 mol/liter, and preferably at least 0.4 mol/liter. The upper limit thereof is preferably 2.5 mols/liter.

The pH of the developer for use in the process of this invention is preferably in the range of from 9 to 13, and more preferably from 10 to 12.

An alkaline agent for setting the pH of the developer includes pH controlling agents such as sodium hydroxide, potassium hydroxide, sodium carbonate, potassium carbonate, sodium tertiary phosphate, and potassium tertiary phosphate.

Buffers such as borates described in JP-A-62-186259 (the term "JP-A" as used herein means an "unexamined published Japanese patent application"); saccharose, acetoxime, and 5-sulfosalicyclic acid, described in JP- A-60-93433; phosphates; and carbonates, may be used as the pH controlling agent.

Furthermore, the aforesaid developer may contain a hardening agent. As the hardening agent, dialdehyde series hardening agents and hydrogensulfite addition products thereof are preferably used and specific examples thereof are glutaraldehyde and a hydrogen-sulfite addition product of it.

The developer for use in this invention may further contain, in addition to the aforesaid components, other additives such as a development inhibitor (e.g., sodium bromide, potassium bromide, and potassium iodide); an organic solvent (e.g., ethylene glycol, diethylene glycol, triethylene glycol, dimethylformamide, methyl cellosolve, hexylene glycol, ethanol, and methanol); and an antifoggant (e.g., a mercapto series compound such as 1-phenyl-5-mercaptotetrazole and sodium 2-mercaptobenzimidazole-5-sulfonate, an indazole series compound such as 5-nitroindazole, and a benztriazole series compound such as 5-methylbenzotriazole).

Furthermore, the developer may contain development accelerators described in *Research Disclosure,* Vol. 176, No. 17643, XXI (December, 1978) and, if necessary, color toning agents, surface active agents, defoaming agents, water softeners, as well as the amino compounds described in JP-A-56-106244.

In the processing process of this invention, the compound described, e.g., in JP-A-56-24347 can be used as a silver stain inhibitor for the developer.

The developer for use in this invention can contain amino compounds such as alkanolamines, described in JP-A-56-106244 and European Patent 136,582A.

Moreover, the developer for use in this invention may further contain the compounds described in L.F.S. Mason, *Photographic Processing Chemistry,* 226–229 (1966), published by Focal Press, U.S. Pat. Nos. 2,193,015 and 2,592,364, and JP-A-48-64933.

For the processing process of this invention, it is better to reduce the swelling percentage of the light-sensitive material (preferably to from 150% to 50%) as described latter to weaken hardening at processing. That is, it is more preferred that the developer for use in this invention does not contain a hardening agent and also it is preferred that the fix solution does not contain a hardening agent but the fix solution may contain a hardening agent at a pH of higher than 4.6 for weakening the hardening reaction. Thus, for each of the developer and the fix solution, a replenisher composed of one part liquid can be used, which gives the advantage that each replenisher can be prepared by simply diluting with water.

The fix solution for use in this invention is an aqueous solution containing a thiosulfate as a fixing agent and the pH thereof is at least 3.8, preferably from 4.2 to 7.0, and more preferably from 4.5 to 5.5.

As the fixing agent, there are sodium thiosulfate and ammonium thiosulfate, but ammonium thiosulfate is particularly preferred from the standpoints of fixing speed. The amount of the fixing agent may be properly changed but is generally from about 0.1 to 6 mols/liter.

The fix solution may further contain a water-soluble aluminum salt functioning as a hardening agent and examples thereof are aluminum chloride, aluminum sulfate, and potassium alum.

The fix solution may further contain tartaric acid, citric acid, gluconic acid, or derivatives thereof singly or as a mixture thereof. The compound is used in an amount of at least 0.005 mol, and preferably from 0.01 to 0.03 mol, per liter of the fix solution If desired, the fix solution can further contain a preservative (e.g., sulfites and hydrogensulfites), a pH buffer (e.g., acetic acid and boric acid), a pH controlling agent (e.g., sulfuric acid), a chelating agent having a water softening faculty, and the compound described in JP-A-62-78551.

In the aforesaid processing process of this invention for silver halide photographic materials, after development and fixing, the light-sensitive material can be processed by wash water or a stabilization solution with a replenishing amount of not more than 3 liters (including 0, i.e., including the case of using recovered wash water) per square meter of the light-sensitive material.

That is, in this invention, water can be saved for the processing and piping for installing the automatic processor can be made unnecessary.

As a method of reducing the amount of replenisher for wash water, etc., a multistage countercurrent system (e.g., two stage system or three stage system) is known from old. When the multistage countercurrent system is applied to the process of this invention, light-sensitive materials are successively processed in a cleaner direction, that is, are successively brought into contact with wash solutions with less stain from a fix solution, whereby more effective washing can be practiced.

In the water saving processing or non-plumbing processing described above, it is preferred to apply a fungicidal means to the wash water or the stabilization solution.

As the fungicidal means which can be used in this invention, there are an ultraviolet irradiation method described in JP-A-60-263939, a method of using a magnetic field described in JP-A-60-263940, a method of using ion-exchange resins for forming pure water described in JP-A-61-131631, and a method of using fungicides described in JP-A-62-115154, JP-A-62-153952, JP-A-62-220951, and JP-A-62-209532.

Furthermore, the microbicides, fungicides, and surface active agents described in L. F. West, "*Water Quality Criteria*" *Photo. Sci. & Eng.,* Vol. 9, No. 6 (1965), M. W. Beach, "*Microbiological Growths in Motion-Picture Processing*" *SMPTE Journal, Vol.* 85 (1976), R. O. Deegan, "*Photo Processing Wash Water Biocides*" *J. Image. Tech.,* 10, No. 6 (1984), and JP-A-57-8542, JP-A-57-58143, JP-A-58-105145, JP-A-57-132146, JP-A-58-18631, JP-A-57-97530, and JP-A-57-157244 can be used together with any of the aforesaid methods.

Furthermore, for the wash bath or the stabilization bath in this invention the following compounds can be used: isothiazoline series compounds described in R. T. Kreiman, *J. Image. Tech.,* 10, No. 6, 242 (1984), isothiazoline series compounds described in *Research Disclosure,* Vol. 205, No. 20526 (May, 1981), isothiazoline series compounds described in ibid.. Vol. 228, No. 22845 (April, 1983), or the compounds described in JP-A-62-209532 as microbiocide.

Moreover, the compounds described in Hiroshi Horiguchi, *Bokin Bobai no Kagaku* (*Microbicidal and Fungicidal Chemistry*), published by Sankyo Shuppan (1957) and *Bokin Bobai Gijutsu* (*Microbicidal and Fungicidal Technique*) *Handbook,* edited by Nippon Bokin Bobai Gakkai published by Hakuhodo (1986), may be used.

When washing is carried out using a small amount of wash water in the process of this invention, it is preferred to use a squeeze roller washing bath described in JP-A-63-18350. Also, it is preferred to employ the constitution of the wash system described in JP-A-63-143548.

Furthermore, a part or the whole of the overflow liquid from the wash bath or the stabilization bath formed by replenishing water provided with a fungicidal means to the wash bath or the stabilization bath with the progress of processing in the process of this invention can be utilized for a processing solution having a fixing faculty as the pre-treatment of washing or the stabilization as described in JP-A-60-235133.

When a silver halide photographic material is processed by an automatic processor including at least the steps of developing, fixing, washing (or stabilizing), and drying described above, it is preferred to finish the steps from the development to drying within 90 seconds, that is, the time required for the leading edge of a light-sensitive material from the initiation of being immersed in the developer to outcoming from the drying zone after being fixed, washed (or stabilized) and dried (so-called dry to dry time) is preferably not longer than 90 seconds, and more preferably not longer than 70 seconds. The dry to dry time is particularly preferably not longer than 60 seconds.

In this invention, "developing step time" or "development time" is the time required for the leading edge of a light-sensitive material from immersing in the development tank liquid of the automatic processor to immersing in the subsequent fix solution. "Fixing time" is the time required for the leading edge of a light-sensitive material from immersing in a fix solution to a subsequent wash tank liquid (or stabilization solution). Also, "washing time" is the time that the light-sensitive material is immersed in the wash tank solution.

Furthermore, "drying time" is the time that the light-sensitive material is in a drying zone which is equipped to the automatic processor and into which a hot blast of 35° C. to 100° C., preferably from 40° C. to 80° C., is blown.

For attaining the quick process of the aforesaid dry to dry time of not longer than 70 seconds, the development time can be shortened to within 20 seconds, and preferably to within 15 seconds and in this case, the development temperature is preferably from 25° C. to 50° C., and more preferably from 30° C. to 40° C.

In the process of this invention, the fixing time and temperature are preferably from about 20° C. to 50° C. and from 20 seconds to 6 seconds, and more preferably from 30° C. to 40° C. and from 15 seconds to 6 seconds, respectively. In the ranges, fix can be sufficiently performed and sensitizing dye(s) can be eluted out to an extent of not causing residual color.

Also, the temperature and time for washing or stabilization are preferably from 0° C. to 50° C. from 20 seconds to 6 seconds, and more preferably from 15° C. to 40° C. and from 15 seconds to 6 seconds, respectively.

In the process of this invention, the photographic light-sensitive material thus developed, fixed, and washed (or stabilized) is dried through squeeze rollers for squeezing off water in the photographic material.

The drying temperature is from about 40° C. to about 100° C. The drying time can be properly changed according each case but is usually from about 5 seconds to 30 seconds. The drying condition is particularly preferably from 40° C. to 80° C. and from 2 seconds to 5 seconds.

When the dry to dry time is not longer than 70 seconds in the processing process of this invention, it is preferred that the rubber rollers as described in JP-A-63-151943 are applied to the outlet of the development tank for preventing the occurrence of uneven development which is specific to quick processing, the flow rate for stirring the developer in the development tank is increased to about 10 meters/min. or more as described in JP-A-63-151944, or the processing solution is stirred more strongly during processing than the standby state as described in JP-A-63-264758. Furthermore, for quick processing as in the process of this invention, it is more preferred that the rollers of the fix solution tank are opposing rollers for increasing the fixing rate. By employing opposing rollers, the number of the rollers can be reduced and the size of the processing talk can be also reduced. That is, the automatic processor can be smaller in size.

In the processing process of this invention, there is no particular restriction on the black and white photographic materials and general black and white light-sensitive materials can be used. In particular, photographic light-sensitive materials for laser printers for forming medical images, light-sensitive materials for printing, medical direct radiographic light-sensitive materials, medical indirect radiographic light-sensitive materials, CRT image recording light-sensitive materials, etc., can be used in the process of this invention.

The production of the light-sensitive materials suitable for the quick processing according to the process of this invention can be realized by one of the following methods or a combination of at least two of the methods:

(1) Silver halide containing little or no iodine is used. That is, silver chloride, silver bromide, silver chlorobromide, silver iodobromide, silver chloroiodobromide, etc., having a silver iodide content of from 0 to 5 mol % is used.

(2) A water-soluble iridium salt is incorporated into the silver halide emulsion.

(3) The coating amount of silver in the silver halide emulsion layer is reduced. For example, the content of silver in the emulsion layer on one surface of the light-sensitive material is reduced to from 1 to 3.5 g/m$^2$, preferably from 1 to 3 g/m$^2$.

(4) The mean grain size of silver halide in the silver halide emulsion is reduced. For example, the mean grain size is reduced to 1.0 μm or less, preferably 0.7 μm or less.

(5) Tabular silver halide grains having an aspect ratio of at least 4, and preferably at least 5 are used as the silver halide grains in the emulsion.

(6) The swelling percentage of the silver halide photographic material being processed is reduced to 200% or less.

For the light-sensitive material being processed by the process of this invention, two or more silver halide emulsion layers may be formed and the coating amount of silver on one surface of the light-sensitive material is preferably from 1 g/m$^2$ to 3.5 g/m$^2$, and more preferably from 1 g/m$^2$ to 3 g/m$^2$ as described above.

The mean grain size of silver halide for the black and white photographic material being processed in this invention is preferably 1.0 μm or less and particularly preferably 0.7 μm or less as mentioned above.

The silver halide grains in the photographic emulsion may be regular grains having a regular crystal form such as cubic, octahedral, and tetradecahedral forms, irregular grains having irregular crystal form such as spherical form, crystals having a crystal defect such as twin crystals, or tabular grains. Also, the silver halide grains may be a composite form of them.

The aspect ratio of tabular grains is given by the ratio of the mean value of the diameters of circles having the same area as the projected area of each grain of the tabular grains to the mean value of the thickness of each grain thereof. In this invention, the tabular silver halide grains have an aspect ratio of preferably from 4 or more and less than 20, and more preferably from 5 or more and less than 10. Furthermore, the thickness of the tabular grains is preferably 0.3 μm or less, and more preferably 0.2 μm or less.

It is preferred that the tabular silver halide grains account for at least 80% by weight, and more preferably at least 90% by weight of the whole silver halide grains.

The grain sizes of silver halide may have a narrow grain size distribution or a broad grain size distribution.

The silver halide photographic emulsion for use in this invention can be produced by a known method such as, for example, the methods described in *Research Disclosure,* No. 17643, pages 22–23, I "Emulsion Preparation and Types", (December, 1978) and ibid., No. 18716 (November, 1979).

The photographic emulsions for use in this invention can be prepared by the methods described in P. Glafkides, *Chemie et Physique Photographique,* Paul Montel (1967), G. F. Duffin, *Photographic Emulsion Chemistry,* Focal Press (1966), and V. L. Zelikman et al, *Making and Coating Photographic Emulsion,* Focal Press (1964).

At the formation of silver halide grains for use in this invention, ammonia, potassium rhodanide, ammonium rhodanide, thioether compounds (described, e.g., in U.S. Pat. Nos. 3,271,157, 3,574,628, 3,704,130, 4,297,439, and 4,276,374), thione compounds (described, e.g., in JP-A-53-144319, JP-A-53-82408, and JP-A-55-77737), amine compounds (described, e.g., in JP-A-54-100717), etc., can be used as a silver halide solvent for controlling the growth of the grains.

Also, in the case of forming silver halide grains, a water-soluble rhodium salt or the aforesaid water-soluble iridium salt can be used.

For reacting a soluble silver salt and a soluble halide for forming silver halide grains a single jet method, a double jet method, or a combination thereof can be used.

A so-called reverse mixing method of forming silver halide grains in the existence of excess silver ions can also be used. As one system of the double jet method, a so-called controlled double jet method of keeping a constant pAg in a liquid phase of forming silver halide grains can also be used. According to the method, a silver halide emulsion containing silver halide grains having a regular crystal form and substantially uniform grain sizes can be obtained.

It is preferred that the silver halide emulsion for use in this invention is chemically sensitized.

For the chemical sensitization, an ordinary sulfur sensitization, reduction sensitization, noble metal sensitization, or a combination thereof is used.

As the practical chemical sensitizers, there are sulfur sensitizers such as allyl thiocarbamide, thiourea, thiosulfate, thioether, and cystine; noble metal sensitizers such as potassium chloroaurate, aurous thiosulfate, and potassium chloropalladate, and reduction sensitizers such as tin chloride, phenylhydrazine, and reductone.

The silver halide emulsion for use in this invention is spectrally sensitized by spectral sensitizing dye(s). Examples of the spectral sensitizing dyes are cyanine dyes, merocyanine dyes, rhodacyaning dyes, styryl dyes, hemicyanine dyes, oxonol dyes, benzylidene dyes, and holopolar dyes described in F. M. Hamer, *Heterocyclic Compounds "The Cyanine Dyes and Related Compounds"*, John Wiley & Sons (1964) and D. M. Sturmer, *Heterocyclic Compounds "Special Topics in Heterocyclic Chemistry"*, John Wiley & Sons (1977). In particular, cyanine dyes and merocyanine dyes are preferred.

As sensitizing dyes which are preferably used for the silver halide photographic materials being processed by the process of this invention, there are cyanine dyes and merocyanine dyes described in JP-A-60-133442, JP-A-61-75339, JP-A-62-6251, JP-A-59-212827, JP-A-50-122928, and JP-A-59-180553.

Practical examples are the sensitizing dyes for spectrally sensitizing silver halide to a spectral blue region, green region, red region or infrared region described in JP-A-60-133442, pages 8–11, JP-A-61-75339, pages 5–7 and 24–25, JP-A-62-6251, pages 10–15, JP-A-59-212827, pages 5–7, JP-A-50-122928, pages 7–9, and JP-A-59-180553, pages 7–18.

These sensitizing dyes may be used singly or as a combination thereof and a combination of sensitizing dyes is frequently used for supersensitization.

The silver halide emulsion may contain a dye having no spectral sensitizing action by itself or a material which does not substantially absorb visible light and shows supersensitization together with the sensitizing dye(s). For example, the emulsion may contain aminostilbene compounds substituted by a nitrogen-containing heterocyclic group described, e.g., in U.S. Pat. Nos 2,933,390 and 3,635,721, aromatic organic acid-formaldehyde condensates described in U.S. Pat. No. 3,743,510, cadmium salts, azaindene compounds, etc. The combinations of materials described in U.S. Pat. Nos. 3,615,613, 3,615,541, 3,617,295 and 3,635,721 are particularly useful.

The sensitizing dye(s) are contained in the silver halide photographic emulsion in an amount of from $5\times10^{-7}$ mol to $5\times10^{-2}$ mol, preferably from $1\times10^{-6}$ mol to $1\times10^{-3}$ mol, and particularly preferably from $2\times10^{-6}$ mol to $5\times10^{-4}$ mol per mol of silver halide.

The aforesaid sensitizing dye(s) can be directly dispersed in the emulsion layer. Also, the senstizing dye(s) can be added to the emulsion as a solution in a proper solvent such as methanol, ethanol, methyl cellosolve, acetone, water, pyridine, or a mixture thereof. Also, at the dissolution of the sensitizing dyes, ultrasonic waves can be utilized.

Also, as the addition method of the sensitizing dye(s), there are a method of dissolving a dye(s) in a volatile organic solvent, dispersing the solution in a hydrophilic colloid, and adding the dispersion to a silver halide emulsion as described in U.S. Pat. No. 3,469,987; a method of dispersing a water-insoluble dye(s) in a water-soluble solvent without dissolving therein and adding the dispersion to an emulsion as described in JP-B-46-24185 (the term "JP-B" as used herein means an "examined published Japanese patent application"); a method of mechanically grinding and dispersing a water-insoluble dye(s) in an aqueous solvent and adding the dispersion to an emulsion as described in JP-B-61-45217; a method of dissolving the dye(s) in a surface active agent and adding the solution to an emulsion as described in U.S. Pat. No. 3,822,135; a method of dissolving a dye(s) using a compound of red-shifting and adding the solution to an emulsion as described in JP-A-

51-74624; and a method of dissolving a dye(s) in an acid containing substantially no water and adding the solution to an emulsion as described in JP-A-50-80826.

As other methods of adding the sensitizing dyes to emulsions, the methods described in U.S. Pat. Nos. 2,912,343, 3,342,605, 2,996,287, and 3,429,835 can be used.

Also, the sensitizing dye(s) may be uniformly dispersed in a silver halide emulsion before coating the emulsion on a proper support and as a matter of course, the dyes can be dispersed in the silver halide emulsion at any stage in the preparation of the emulsion. For example, the dye(s) may be dispersed before or at the chemical sensitization thereof or at the formation of the silver halide grains or before or after thereof according to U.S. Pat. Nos. 4,183,756 and 4,225,666.

It is known that when the sensitizing dye(s) are added to the emulsion at or before the chemical sensitization thereof or at or before or after the formation of the silver halide grains, the dye(s) adsorb strongly to the silver halide but in this invention, the problem of residual color can be completely solved even in the case of using the light-sensitive material using the silver halide emulsion prepared as described above.

The aforesaid sensitizing dye(s) can be further used as a combination of other sensitizing dyes. For example, the sensitizing dyes described in U.S. Pat. Nos. 3,703,377, 2,688,545, 3,397,060, 3,615,635, and 3,628,964, British Pat. Nos. 1,242,588 and 1,293,862, JP-B-43-4936, JP-B-44-14030, JP-B-43-10773, and JP-B-43-4930, U.S. Pat. Nos. 3,416,927, 2,615,613, 3,615,632, 3,617,295, and 3,635,721 can be used.

For quickly processing the silver halide photographic materials according to the process of this invention, it is preferred that the swelling percentage of the silver halide photographic material is reduced to 200% or less.

On the other hand, if the swelling percentage becomes too low, the speeds of the development, fixing, and washing are reduced and thus it is not preferred to reduce it too much. Thus, the preferred swelling percentage is from 30% to 200%, and particularly from 50% to 150%.

For reducing the swelling percentage to 200% or less, the swelling percentage can be easily controlled by, for example, increasing the amount of a hardening agent for the light-sensitive materials.

The swelling percentage can be easily determined by: (a) subjecting a photographic light-sensitive material to an incubation treatment for 3 days at 38° C. and at a relative humidity of 50%, (b) measuring the thickness of the hydrophilic colloid layer, (c) immersing the light-sensitive material in distilled water at 21° C. for 3 minutes, and (d) comparing the thickness of the hydrophilic colloid layer with the thickness obtained in step (b), whereby the change of the thickness is shown by a percentage.

As a hardening agent for use in this invention, there are aldehyde compounds, compounds having an active halogen described in U.S. Pat. No. 3,288,775, compounds having a reactive ethylenically unsaturated group described in U.S. Pat. No. 3,635,718, epoxy compounds described in U.S. Pat. No. 3,091,537, and organic compounds such as halogenocarboxyaldehydes (e.g., mocochloric acid). In these compounds, vinylsulfone series hardening agents are preferred. Furthermore, high molecular weight hardening agents can be preferably used.

As the high molecular weight hardening agent, polymers having an active vinyl group or a group that becomes the precursor thereof are preferred and in particular, polymers wherein an active vinyl group or a group that becomes the precursor thereof is bonded to the polymer main chain by a long spacer are preferred.

The addition amount of the hardening agent for attaining the aforesaid swelling percentage differs according to the kind of hardening agent and the kind of gelatin.

In the quick processing of this invention it is preferred that organic materials which flow out in the processing steps exist in the emulsion layer and/or other hydrophilic layer(s).

When the material which flows out is a gelatin, it is preferred that the gelatin does not take part in the cross-linking reaction of gelatin by a hardening agent and examples of such a gelatin are acetylated gelatin and phthalated gelatin, and gelatin having a small molecular weight is preferred.

On the other hand, as other polymers than gelatin, there are polyacrylamide as described in U.S. Pat. No. 3,271,158 and other hydrophilic polymers such as polyvinyl alcohol and polyvinylpyrrolidone. Also saccharides such as dextran, saccharose, and pullulan can be effectively used. In these materials, polyacrylamide and dextran are preferred and polyacrylamide is particularly preferred. The mean molecular weight of these materials is preferably not more than 20,000, and more preferably not more than 10,000.

As other materials, the antifoggants and stabilizers described in *Research Disclosure,* Vol. 176, No. 17643, VI, (December, 1978) can be used for the light-sensitive materials.

The processing process of this invention can be applied for the image forming process of a silver halide photographic material capable of obtaining photographic characteristics of super high contrast and high sensitivity using the hydrazine derivatives described in U.S. Pat. Nos. 4,224,401, 4,168,977, 4,166,742, 4,311,781, 4,272,606, 4,221,857, and 4,243,739.

The hydrazine derivatives described in *Research Disclosure,* Item 23516, page 346 (November, 1983), the references cited in the aforesaid literature, U.S. Pat. Nos. 4,080,207, 4,269,929, 4,276,364, 4,278,748, 4,385,108, 4,459,347, 4,560,638, and 4,478,928, British Pat. No. 2,011,391B, and JP-A-60-179734 can be used. The addition amount of the hydrazine derivative is preferably from $1\times10^{-6}$ mol to $5\times10^{-2}$ mol and particularly preferably from $1\times10^{-5}$ mol to $2\times10^{-2}$ mol per mol of silver halide.

Also, it is preferred that the developer being used for processing in the case of using the hydrazine derivative contains the amino compound described in U.S. Pat. No. 4,269,929 as a hardening accelerator.

Now, the invention is practically described by the following examples but the invention is not limited to them.

EXAMPLE 1

Preparation of Emulsion

To 1 liter of water were added 30 g of gelatin and 6 g of potassium bromide in a vessel kept at 60° C. and then an aqueous silver nitrate solution (5 g as silver nitrate) and an aqueous solution of potassium bromide containing 0.15 g of potassium iodide were added to the mixture over a period of one minute by a double jet method with stirring. Furthermore, an aqueous silver nitrate solution (145 g as silver nitrate) and an aqueous solution of potassium bromide containing 4.2 g of potassium iodide were added thereto by a double jet method. In this case, the addition speed was so accelerated that the flow rate at the end of the addition was 5 times that at the initiation of the addition. After finishing the addition, soluble salts were removed by a flocculation method at 35° C. After increasing the temperature of the system to 40° C., 75 g of gelatin was added and the pH of the mixture was adjusted to 6.7. The emulsion obtained contained tabular silver halide grains having a projected area diameter of 0.98 μm and a mean thickness of 0.138 μm and the silver iodide content was 3 mol %. To the emulsion was applied a chemical sensitization by a combination of gold sensitization and sulfur sensitization.

Preparation of Photographic Material 101

For a surface protective layer, an aqueous gelatin solution containing polyacrylamide having a mean molecular weight of 8,000, sodium polystyrenesulfonate, polymethyl methacrylate fine particles (mean particle size 3.0 μm), polyethylene oxide, and a hardening agent in addition to gelatin was used.

To the emulsion prepared above were added 500 mg/mol-Ag of anhydro-5,5'-dichloro-9-ethyl-3,3'-di(3-sulfopropyl)oxacarbocyanine hydroxide sodium salt as a sensitizing dye and 200 mg/mol-Ag of potassium iodide. Furthermore, 4-hydroxy-6-methyl-1,3,3a,7-tetraazaindene and 2,6-bis(-hydroxyamino)-4-diethylamino-1,3,5-triazine were added to the emulsion as stabilizers. Then, to the emulsion were further added nitron, trimethylolpropane as a drying antifoggant, a coating aid, and a hardening agent to provide a coating composition for the emulsion layer.

The coating composition for the emulsion layer and the coating composition for the protective layer prepared above were simultaneously coated on both sides of a polyethylene terephthalate support followed by drying to provide a photographic material 101. The coated amount of silver of the photographic material 101 was 2 g/m$^2$ per one side. Also, the swelling percentage thereof was 120%. The photographic material 101 was exposed to X-rays and processed using the developer, the fix solution, and the wash solution having the compositions shown below.

Developer Concentrate

Potassium hydroxide: 60 g
Sodium sulfite: 100 g
Potassium sulfite: 125 g
Diethylenetriaminepentaacetic acid: 6 g
Boric acid: 25 g
Hydroquinone: 87.5 g
Diethylene glycol: 28 g
4-Hydroxymethyl-4-methyl-1-phenyl-3-pyrazolidone: 6.25 g
5-Methylbenzotriazole: 0.15 g
Water to make: 1 liter
pH adjusted to: 11.00
Replenisher kit size: 5 liters Fix Solution Concentrate Ammonium thiosulfate: 560 g
Sodium sulfite: 60 g
Disodium ethylenediaminetetraacetate (dihydrate): 0.10 g
Sodium hydroxide: 24 g
The compound of the invention: Shown in Table 1
Water to make: 1 liter
pH adjusted by acetic acid to: 5.10
Replenisher kit size: 5 liters Water Stock Tank Solution Disodium ethylenediaminetetraacetate (dihydrate) (antifoggant): 0.5 g/l The schematic view of the automatic processor used in Example 1 is shown in the Figure and the process was carried out at 60 second processing in dry to dry time.

The automatic processor is now explained by referring to the FIGURE.

Development tank 1: 7.5 liters 35° C.×11.5 sec. (opposing rollers)
Fix Tank 2: 7.5 liters 35° C.×12.5 sec. (opposing rollers)
Wash tank 3: 6 liters 20° C.×7.5 sec. (opposing rollers)
Squeeze roller wash tank 7: 200 ml
Water stock tank 4:25 liters
Drying In this case, heaters were used for keeping the temperatures of the development tank 1 and the fix tank 2 but cooling water was not used.

At the start of processing, each tank was filled with the processing solution as follows.

Development tank 1

A mixture of 400 ml of the aforesaid developer concentrate and 600 ml of water, the pH of which was adjusted to 10.50 by the addition of 10 ml of an aqueous solution containing 2 g of potassium bromide and 1.8 g of acetic acid.

Fix tank 2

A mixture of 250 ml of the aforesaid fix solution concentrate and 750 ml of water.

Wash tank 3 and squeeze roller wash tank 7

A solution having the same composition as the stock tank solution described above.

As shown in the Figure, while replenishing 30 ml of a mixture of 20 ml of the developer concentrate (from a developer concentrate stock tank 5) and the stock tank water to the development tank 1, 30 ml of a mixture of 10 ml of the fix solution concentrate (from a fix solution concentrate stock tank 6) and a part of the overflow solution of the wash tank 3 to the fix tank 2, and 60 ml of the stock tank water to the wash tank 3 from the squeeze roller wash tank 7 opposite direction to the travelling direction of the light-sensitive sheet) with processing of one sheet (10 inch x 12 inch) of the aforesaid photographic material 101, the running processing was continued for 50 sheets (the developing ratio of one sheet was 40%) per day. During processing, each replenisher was supplied to each of the developer, the fix solution, and the wash solution.

In the FIGURE, the designation "P" means a pump.

In addition, when the photographic material 101 was processed, the circulating rate of the developer for stirring was set to 20 liters/min. and when the photographic material 101 was not processed, the circulating rate was set to 6 liters/min.

After finishing the processing operation for one day, the rollers disposed between the development zone and the fix zone and between the fix zone and the wash zone were cleaned by intermittently and automatically spraying through 10 small holes 80 ml of water in the water stock tank 4 for wash water (as shown in JP-A-62-287252).

The dry to dry processing time was set at 60 seconds as described above.

Residual color (the value obtained by measuring the transmitted optical density at a non-image portion by green light) after processing is shown in Table 1 below.

TABLE 1

| Compound Added to Fix Solution | Addition Amount (g/l) | Residual Color after Processing (transmitted optical density) |
|---|---|---|
| Control | — | 0.209 |
| Comparison Compound (a) | 7.9 | 0.208 |
| Comparison Compound (b) | 0.6 | 0.189 |
| Compound (2) | 1.3 | 0.163 |
| Compound (3) | 0.84 | 0.166 |
| Compound (6) | 1.5 | 0.165 |
| Compound (7) | 2.4 | 0.151 |
| Compound (8) | 1.8 | 0.149 |
| Compound (10) | 2.4 | 0.150 |
| Compound (11) | 2.5 | 0.148 |
| Compound (12) | 2.0 | 0.164 |
| Compound (15) | 1.9 | 0.147 |
| Compound (16) | 2.7 | 0.146 |
| Compound (17) | 2.0 | 0.147 |
| Compound (20) | 2.1 | 0.148 |
| Compound (21) | 2.1 | 0.151 |
| Compound (23) | 1.9 | 0.152 |
| Compound (24) | 2.9 | 0.150 |
| Compound (25) | 3.3 | 0.152 |
| Compound (35) | 1.7 | 0.149 |
| Compound (36) | 1.5 | 0.147 |
| Compound (37) | 1.8 | 0.149 |
| Compound (38) | 2.0 | 0.148 |
| Compound (51) | 3.8 | 0.147 |
| Compound (53) | 4.4 | 0.150 |
| Compound (54) | 3.9 | 0.147 |
| Compound (56) | 3.6 | 0.148 |

The compounds used for the comparison samples shown in Table 1 were as follows.

Comparison Compound (a)

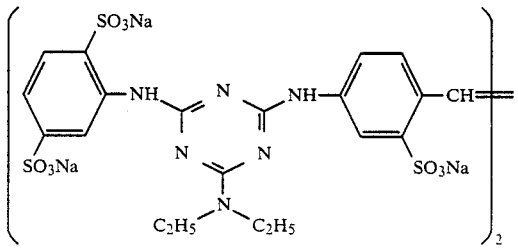

Molecular weight: 1369 The molecular extinction coefficient of the aqueous solution of the compound prepared by the condition 1 was 0 (624 nm).

Comparison Compound (b)

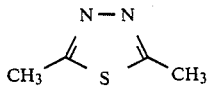

Molecular weight: 114 The molecular extinction coefficient of the aqueous solution of the compound prepared by the condition 1 was $1.6\times10^5$ (624 nm).

As shown in Table 1, when the light-sensitive materials were processed by the fix solution containing the compound defined in this invention, the occurrence of residual color after processing was less.

Similarly, when the aforesaid light-sensitive material was processed by adding 1.3 g/liter of Compound (2) or 1.8 g/liter of Compound (8) to the wash solution, the residual color after processing was less as 0.162 and 0.150, respectively.

EXAMPLE 2

By following the same procedure as in the case of preparing the photographic material 101 in Example 1 using the sensitizing dyes shown below, photographic materials (Samples 201 to 228) were prepared.

Each of the photographic materials was processed by the automatic processor as in Example 1 and the residual color density [i.e., the difference between (the residual color density in the case of not using the compound satisfying condition 1 for the fix solution) and (the residual color density in the case of using the compound defined in the invention)] is shown in Table 2 below.

TABLE 2

| Sample No. | Sensitizing Dye (amount mg/l molAg) | Compound Added to Fix Solution (amount g/l) | Residual Color (difference)* |
|---|---|---|---|
| 201 | A (500) | (2) (1.3) | 0.061 |
| 202 | B (500) | (8) (1.8) | 0.063 |
| 203 | C (400) | (8) (1.8) | 0.057 |
| 204 | D (500) | (8) (1.8) | 0.062 |
| 205 | E (500) | (10) (2.3) | 0.059 |
| 206 | F (500) | (8) (1.8) | 0.063 |
| 207 | G (500) | (10) (2.3) | 0.064 |
| 208 | A (500) | (15) (1.9) | 0.065 |
| 209 | B (500) | (17) (2.0) | 0.062 |
| 210 | C (400) | (17) (2.0) | 0.061 |
| 211 | D (500) | (15) (1.9) | 0.064 |
| 212 | E (500) | (17) (2.0) | 0.065 |
| 213 | F (500) | (17) (2.0) | 0.067 |
| 214 | G (500) | (12) (3.3) | 0.067 |
| 215 | A (500) | (35) (1.7) | 0.065 |
| 216 | B (500) | (37) (1.8) | 0.066 |
| 217 | C (400) | (35) (1.7) | 0.061 |
| 218 | D (500) | (35) (1.8) | 0.069 |
| 219 | E (500) | (44) (2.0) | 0.066 |
| 220 | F (500) | (35) (1.7) | 0.067 |
| 221 | G (500) | (44) (2.0) | 0.069 |
| 222 | A (500) | (51) (3.8) | 0.064 |
| 223 | B (500) | (53) (4.4) | 0.065 |
| 224 | C (400) | (51) (3.8) | 0.060 |
| 225 | D (500) | (51) (3.8) | 0.067 |
| 226 | E (500) | (54) (3.9) | 0.064 |
| 227 | F (500) | (51) (3.8) | 0.064 |
| 228 | G (500) | (54) (3.9) | 0.067 |

*Difference between residual color in the case of not using the compound difines in this invention and residual color in the case of suing the compound.

As shown in the above table, it can be seen that in the case of processing the fix solution containing the compound defined in this invention, residual color is less in each case.

The sensitizing dyes used in the examples are as follows.

A

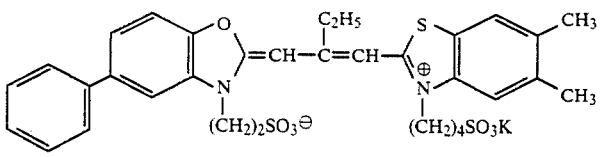

B

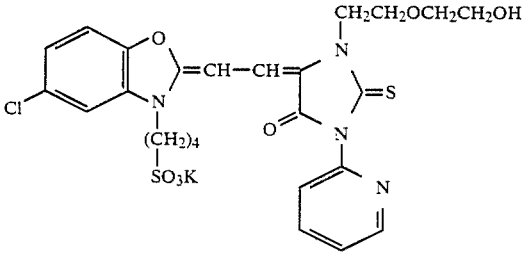

C

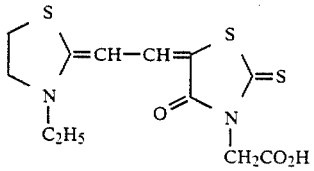

D

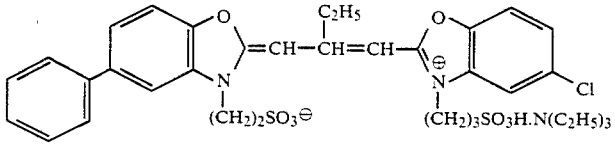

E

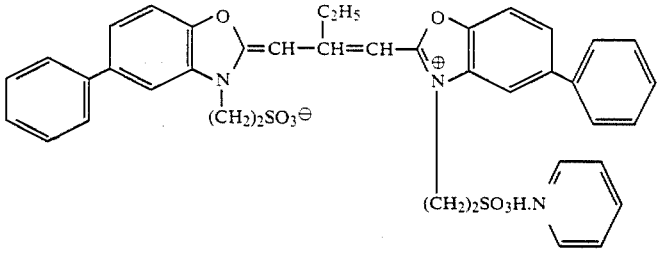

F

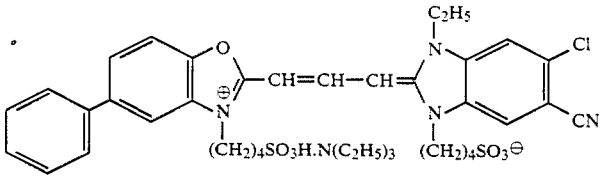

G

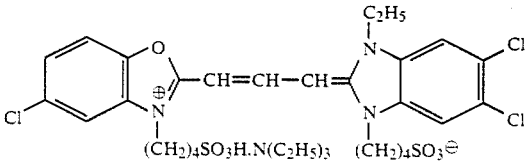

EXAMPLE 3

To a silver iodobromide emulsion containing cubic grains having a mean grain size of 0.3 μm and containing 2.5 mol % iodide were added 230 mg/mol-Ag of anhydro-5,5-dichloro-9-ethyl-3,3'-bis(3-sulfopropyl)oxacarboxyamine hydroxide.sodium salt (sensitizing dye), 1.3 g/mol-Ag of a hydrazine derivative (shown below), and 300 mg/mol-Ag of polyethylene glycol (molecular weight of about 1,000) and further 5-methylbenzotriazole, 4-hydroxy-6-methyl-1,3,3a,7-tetraazaindene, a dispersion of polyethylene acrylate, and 2-hydoxy-1,3,5-triazine sodium salt were added thereto. Furthermore, 1,3-divinylsulfonyl-2-propanol was added to the emulsion such that the swelling percentage became 120%.

The coating composition thus prepared was coated on a poilyethylene terephthalate film support together with a protective layer as shown in Example 1 at a silver coverage of 3.5 g/m$^2$ and a gelatin coverage (the sum of gelatin in the emulsion layer and the protective layer) of 3.0 g/m$^2$ to provide a photographic film.

Hydrazine Derivative

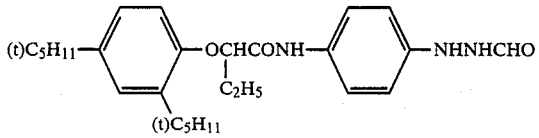

The photographic film was exposed through a sensitometric exposure wedge using a 150 line magenta contact screen, developed by the developer having the composition shown below for 15 seconds at 40° C., fixed using a fix solution, GR-Fl (trade name, made by Fuji Photo Film Co., Ltd.), washed and dried.

The automatic processor used was set at 65 seconds in dry to dry processing time.

Developer Composition

Tetrasodium ethylenediaminetetraacetate: 1.0 g
Sodium hydroxide: 9.0 g
5-Sulfosalicyclic acid: 44.0 g
Potassium sulfite: 100.0 g
0.5-Methylbenzotriazole: 0.5 g
Potassium bromide: 6.0 g
N-Methyl-p-aminophenol $\frac{1}{2}H_2SO_4$:0.4 g
Hydroquinone:54.0 g
Sodium p-toluenesulfonate:30.0 g
Water to make:1 liter
pH:11.7

The wash solution had the same composition as the aqueous solution used in Example 1 and 250 ml of the solution was replenished per one large size sheet (20 inch×24 inch) of the photographic film.

Similarly, in the aforesaid processing, 1.8 g/liter of Compound (8) in this invention was added to the aforesaid fix solution.

When the residual color after processing was measured as in Example 1, the case of using the Compound (8) was 0.051 less in residual color density than the case of processing without using the compound.

Also, the same procedure was followed by adding 2.0 g/liter of Compound (17), 1.7 g/liter of Compound (35), or 3.8 g/liter of Compound (51) to the fix solution, the residual color was 0.053, 0.060, or 0.058 less in residual color density than the case of not using the compound, respectively.

EXAMPLE 4

To an aqueous gelatin solution kept at 50° C. were simultaneously added an aqueous silver nitrate solution and an aqueous solution of potassium iodide and potassium bromide in the existence of $4\times10^{-7}$ mol of potassium iridium(III) hexachloride per mol of silver and ammonia over a period of 60 minutes while keeping the pAg at 7.8 during the addition, whereby a cubic mono-dispersed silver halide emulsion having a mean grain size of 0.25 μm and a mean silver iodide content of 1 mol % was obtained.

To the emulsion was added $5.6\times10^{-5}$ mol of the compound shown below per mol of silver as a sensitizing dye.

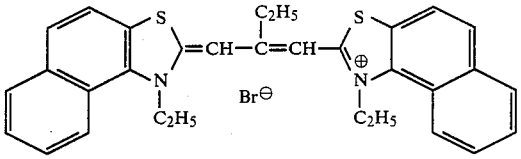

Furthermore, after adding thereto 4-hydroxy-6-methyl-1,3,3a,7-tetraazaindene as a stabilizer, a dispersion of polyethylene acrylate, polyethylene glycol, 1,3-vinylsulfonyl-2-propanol, 1-phenyl-5-mercaptotetrazole, 1,4-bis[3-(4-acetylaminopyridinio)propyionyloxy]tetramethylene dibromide, and the hydrazine derivative ($4.8\times10^{-3}$ mol per mol of silver) as used in Example 3, the emulsion was adjusted to 5.5 in pH of the layer surface by ascorbic acid and coated on a polyethylene terephthalate film at a silver coverage of 3.4 g/m$^2$. (In addition, the pH on the film surface was performed by the method described in JP-A-62-25745).

In this case, a gelatin coating composition was simultaneously coated on the emulsion layer at a gelatin coverage of 1.0 g/m$^2$.

The photographic film was exposed, developed by the developer having the following composition, and the photographic characteristics were measured.

Developer Composition

Hydroquinone: 35.0 g
N-Methyl-p-aminophenol $\frac{1}{2}$sulfate: 0.8 g
Sodium hydroxide: 13.0 g
Potassium tertiary phosphate: 74.0 g
Potassium sulfite: 90.0 g
Tetrasodium ethylenediaminetetraacetate dihydrate: 1.0 g
Potassium bromide: 4.0 g
5-Methylbenzotriazole: 0.6 g
3-Diethylamino-1,2-propanediol: 15.0 g
Water to make: 1 liter
pH: 11.65

The composition of the fix solution used was as follows.

Ammonium thiosulfate: 150.0 g
Sodium sulfite: 30.0 g
Acetic acid: 30.0 g
Compound (8) in the invention: 1.8 g
Water to make: 1 liter
pH adjusted to 5.00 by sodium hydroxide.

The processing step was as follows.

| | | |
|---|---|---|
| Development | 40° C. | 15 seconds |
| Fix | 37° C. | 16 seconds |
| Wash | | 12 seconds |
| Dry to dry | | 67 seconds |

The sample thus processed showed good photographic performance (Dmax and sensitivity) and the occurrence of residual color was less (0.033 as red sensitivity).

EXAMPLE 5

By employing a double jet method while controlling the temperature at 60° C., pAg at 8.0 and pH at 2.0, a silver iodobromide mono-dispersed cubic crystal grain emulsion containing 2.0 mol % silver iodoide and having a mean grain size of 0.20 μm was obtained. Using a part of the emulsion as a core, the silver halide crystal was grown as shown below. That is, to a solution containing the core grains and gelatin were added an aqueous ammoniacal silver nitrate solution and an aqueous solution containing potassium iodide and potassium bromide by a double jet method at 40° C., pAg of 9.0 and pH of 9.0 to form a first coating layer containing 30% silver iodide. Furthermore, an aqueous ammoniacal silver nitrate solution and an aqueous potassium bromide solution were added thereto by a double jet method at pAg of 9.0 and pH of 9.0 to form a second coating layer of pure silver bromide. Thus, a cubic mono-dispersed silver iodobromide emulsion (E-1) having a mean grain size of 0.57 μm was prepared. The mean silver iodide content of the emulsion was 2.0 mol %.

To the emulsion E-1 were added the sensitizing dyes A and B shown below in the amounts shown below. Then, $8\times10^{-7}$ mol of chloroaurate, $7\times10^{-6}$ mol of sodium thiosulfate, and $7\times10^{-4}$ mol of ammonium thiocyanate were added to the emulsion to perform properly gold and sulfur sensitizations and after adding thereto $2\times10^{-2}$ mol of 4-hydroxy-6-methyl-1,3,3a,7-tetraazaindene as a stabilizer, the gelatin concentration was adjusted to 2.25 g/m² (per one side).

Sensitizing Dye A 450 mg/mol-AgX

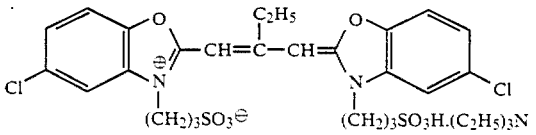

Sensitizing Dye B 20 mg/mol-AgX

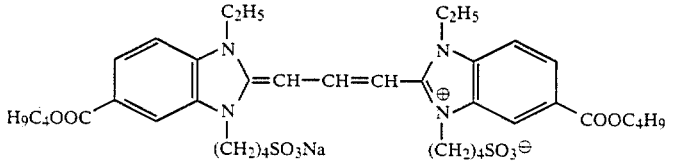

Furthermore, the additives shown below were added to the emulsion and a coating composition for a protective layer, respectively and a hardening agent shown below was added thereto such that the melting time became 20 minutes.

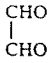

That is, to the emulsion were added 400 mg of t-butyl-catechol, 1.0 g of polyvinylpyrrolidone (molecular weight 10,000), 2.5 g of a styrene-malic anhydride co-polymer, 10 g of trimethylolpropane, 5 g of diethylene glycol, 50 mg of nitrophenyl-triphenyl phosphonium chloride, 4 g of ammonium 1,3-dihydroxybenzene-4-sulfonate, 15 mg of sodium 2-mercaptobenzimidazole-5-sulfonate, 70 mg of

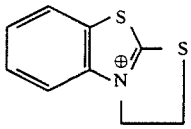

$CH_3SO_3^{\ominus}$, 1 g of

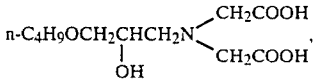

and 10 mg of 1,1-dimethylol-1-bromo-1-nitromethane per mol of silver halide.

The emulsion described above and the coating composition for a protective layer of 1.15 g/m² (per one side) of gelatin added with the hardening agent such that the melting time became 20 minutes and also the additives shown below were simultaneously coated on both sides of a polyester film support having a subbing layer by a slide hopper method at a coating speed of 60 meters/min. to form a silver halide emulsion layer (viscosity 11 c.p., surface tension 35 dyn/cm, and coated layer thickness 50 μm) and a protective layer (viscosity 11 c.p., surface tension 25 dyn/cm, and coated layer thickness °μm), whereby a photographic material (Sample 401) was obtained. The silver coverage was 45 mg/dm² on each side.

Also, in this case, the following compounds were added to the coating composition for the protective layer per gram of gelatin.

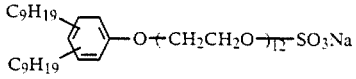

10 mg,

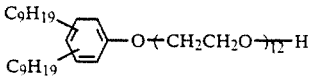

2 mg,

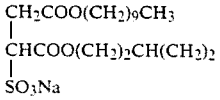

7 mg,

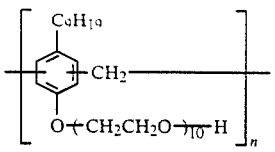

15 mg, (mixture of n being 2 ~ 5)

Furthermore, 7 mg of a matting agent composed of polymethyl methacrylate having a mean particle size of 5 μm and 70 mg of colloidal silica having a mean particle size of 0.013 μm were also added to the coating composition for the protective layer.

For the sample, the amount of the hardening agent was adjusted such that the melting time measured by the method shown below became 20 minutes.

That is, the time required from the immersion of the sample of 1 cm x 2 cm in an aqueous 1.5% sodium hydroxide solution kept at 50° C. to beginning the elution of the emulsion layer was employed as the melting time.

Also, the sensitivity and the fog were measured as follows. The sample was inserted between two optical wedges, the density inclination of which was adjusted to mirror symmetry, and both sides thereof were simultaneously exposed to a light source of 5,400° K in color temperature at both sides for 1/12.5 second.

The sample was then processed by the following steps using a roller-transferring type automatic processor for a total processing time of 45 seconds.

| | Processing Temperature | Processing Time (sec.) |
|---|---|---|
| Insertion | | 1.2 |
| Development + transfer | 35° C. | 14.6 |
| Fix + transfer | 33° C. | 8.2 |
| Wash + transfer | 25° C. | 7.2 |
| Squeezing | 40° C. | 5.7 |
| Drying | 45° C. | 8.1 |
| Sum | | 45.0 |

In addition, in this Example, the automatic processor having the following construction was used.

That is, rubber rollers were used, in which the rubber material for the rubber rollers outside the processing solutions was silicon rubber (hardness 48° ) and the rubber material for the rubber rollers in the processing solutions was EPDM (hardness 46° ), one kind of ethylene-propylene rubber. The surface roughness of the rollers was 4 μm in Dmax, the number of the rollers was 6 in the development zone and the total number of the rollers was 84. The number of opposing rollers was 51 and thus the ratio of opposing rollers/all rollers was 51/84=0.61. The amount of the replenisher for the developer was 20 ml per sheet film (10 inch×12 inch), the replenisher amount for the fix solution was 45 ml per sheet film (10 inch×12 inch), and the amount of wash water was 1.5 liters/min. The blast rate in the drying zone was 11 meters/min., and the capacity of the heater was 3 kW (200 volts).

The whole processing time was 45 seconds as described above.

As the developer, Developer-1 shown below was used.

Also, the fix solution used was Fix Solution-1 shown below.

Developer 1

Potassium sulfite: 55.0 g
Hydroquinone: 25.0 g
1-Phenyl-3-pyrazolidon: 1.2 g
Boric acid: 10.0 g
Sodium hydroxide: 21.0 g
Triethylene glycol: 17.5 g
5-Nitrobenzimidazole: 0.10 g
5-Nitroindazole: 0.14 g
Glutaraldehyde hydrogensulfite: 15.0 g
Glacial acetic acid: 16.0 g
Potassium bromide: 4.0 g
Triethylenetetraminehexaacetic acid: 2.5 g
Compound in this invention shown in Table 3
Water to make: 1 liter Fix Solution 1

Ammonium thiosulfate: 130.9 g
Anhydrous sodium sulfite: 7.3 g
Boric acid: 7.3 g
Acetic acid (90 wt%): 5.5 g
Sodium acetate trihydrate: 25.8 g
Aluminum sulfate $18H_2O$: 14.6 g
Sulfuric acid (50 wt%): 6.77 g
Compound in this invention shown in Table 3
Water to make: 1 liter The residual color was measured. That is, the transmitted optical density of the non-image portion by green light was measured.

Also, when the same processing as above was followed while reducing the line speed of the aforesaid automatic processor from 45 seconds to 90 second processing, the sensitivity of the light-sensitive material was determined.

The results obtained are shown in Table 3 below.

TABLE 3

| | | Added Bath | | | 90 Second Processing | | 45 Second Processing | | |
|---|---|---|---|---|---|---|---|---|---|
| Test No. | Compound | Developer Bath | Fix Bath | Total Added Amount | Sensitivity | Residual Color after Processing (transmitted Optical Density) | Sensitivity | Fog | Residual Color after Processing (transmitted Optical Density) |
| 1 | Control | — | — | — | 100 | 0.185 | 95 | 0.04 | 0.209 |
| 2 | Comparison Compound (a) | — | O | 7.9 | 100 | 0.184 | 85 | 0.03 | 0.207 |
| 3 | Comparison Compound (b) | — | O | 0.6 | 95 | 0.152 | 95 | 0.04 | 0.189 |
| 4 | Compound (2) | — | O | 1.3 | 105 | 0.149 | 100 | 0.03 | 0.157 |
| 5 | Compound (3) | — | O | 0.84 | 100 | 0.151 | 100 | 0.04 | 0.160 |
| 6 | Compound (6) | — | O | 1.5 | 100 | 0.151 | 100 | 0.03 | 0.163 |
| 7 | Compound (7) | — | O | 2.4 | 105 | 0.147 | 95 | 0.03 | 0.151 |
| 8 | Compound (8) | — | O | 1.8 | 105 | 0.147 | 100 | 0.03 | 0.150 |
| 9 | Compound (10) | — | O | 2.4 | 100 | 0.147 | 100 | 0.03 | 0.150 |
| 10 | Compound (11) | — | O | 2.5 | 100 | 0.146 | 95 | 0.03 | 0.147 |
| 11 | Compound (12) | — | O | 2.0 | 100 | 0.153 | 100 | 0.04 | 0.163 |
| 12 | Comparison Compound (a) | O | — | 7.9 | 95 | 0.184 | 90 | 0.05 | 0.210 |
| 13 | Comparison Compound (b) | O | O | 0.6 (for each bath) | 95 | 0.155 | 90 | 0.03 | 0.185 |
| 14 | Compound (2) | O | — | 1.3 | 105 | 0.149 | 105 | 0.03 | 0.158 |
| 15 | Compound (2) | O | O | 1.3 (for each bath) | 105 | 0.149 | 105 | 0.03 | 0.154 |
| 16 | Compound (6) | O | — | 1.5 | 110 | 0.153 | 105 | 0.02 | 0.163 |

TABLE 3-continued

| Test No. | Compound | Added Bath: Developer Bath | Added Bath: Fix Bath | Total Added Amount | 90 Second Processing: Sensitivity | 90 Second Processing: Residual Color after Processing (transmitted Optical Density) | 45 Second Processing: Sensitivity | 45 Second Processing: Fog | 45 Second Processing: Residual Color after Processing (transmitted Optical Density) |
|---|---|---|---|---|---|---|---|---|---|
| 17 | Compound (6) | O | O | 1.5 (for each bath) | 110 | 0.151 | 105 | 0.02 | 0.160 |
| 18 | Compound (7) | O | — | 1.8 | 115 | 0.148 | 110 | 0.02 | 0.152 |
| 19 | Compound (7) | O | O | 1.8 (for each bath) | 115 | 0.148 | 110 | 0.02 | 0.150 |
| 20 | Compound (15) | — | O | 1.9 | 110 | 0.147 | 100 | 0.03 | 0.153 |
| 21 | Compound (16) | — | O | 2.7 | 100 | 0.148 | 100 | 0.04 | 0.154 |
| 22 | Compound (17) | — | O | 2.0 | 100 | 0.146 | 100 | 0.03 | 0.149 |
| 23 | Compound (20) | — | O | 2.1 | 100 | 0.147 | 95 | 0.03 | 0.151 |
| 24 | Compound (21) | — | O | 2.1 | 105 | 0.146 | 100 | 0.03 | 0.148 |
| 25 | Compound (23) | — | O | 1.9 | 100 | 0.147 | 100 | 0.03 | 0.150 |
| 26 | Compound (24) | — | O | 2.9 | 105 | 0.145 | 95 | 0.03 | 0.145 |
| 27 | Compound (25) | — | O | 3.3 | 100 | 0.153 | 100 | 0.04 | 0.163 |
| 28 | Compound (15) | O | — | 1.9 | 110 | 0.148 | 105 | 0.03 | 0.153 |
| 29 | Compound (15) | O | O | 1.9 (for each bath) | 110 | 0.146 | 105 | 0.03 | 0.152 |
| 30 | Compound (17) | O | — | 2.0 | 110 | 0.147 | 105 | 0.02 | 0.154 |
| 31 | Compound (17) | O | O | 2.0 (for each bath) | 110 | 0.146 | 105 | 0.02 | 0.152 |
| 32 | Compound (20) | O | — | 2.1 | 115 | 0.146 | 110 | 0.02 | 0.148 |
| 33 | Compound (20) | O | O | 2.1 (for each bath) | 115 | 0.146 | 110 | 0.02 | 0.147 |
| 34 | Compound (35) | — | O | 1.7 | 100 | 0.147 | 100 | 0.04 | 0.150 |
| 35 | Compound (36) | — | O | 1.5 | 100 | 0.146 | 100 | 0.03 | 0.151 |
| 36 | Compound (38) | — | O | 1.8 | 100 | 0.147 | 100 | 0.04 | 0.149 |
| 37 | Compound (44) | — | O | 2.0 | 95 | 0.149 | 95 | 0.03 | 0.153 |
| 38 | Compound (35) | O | — | 1.7 | 95 | 0.147 | 90 | 0.02 | 0.145 |
| 39 | Compound (35) | O | O | 1.7 (for each bath) | 95 | 0.145 | 90 | 0.02 | 0.143 |
| 40 | Compound (36) | O | — | 1.5 | 95 | 0.145 | 90 | 0.01 | 0.142 |
| 41 | Compound (36) | O | O | 1.5 (for each bath) | 95 | 0.144 | 90 | 0.01 | 0.141 |
| 42 | Compound (38) | O | — | 1.8 | 100 | 0.147 | 95 | 0.02 | 0.145 |
| 43 | Compound (38) | O | O | 1.8 (for each bath) | 100 | 0.145 | 90 | 0.02 | 0.142 |
| 44 | Compound (44) | O | — | 2.0 | 95 | 0.147 | 95 | 0.02 | 0.144 |
| 45 | Compound (44) | O | O | 2.0 (for each bath) | 95 | 0.146 | 90 | 0.02 | 0.143 |
| 46 | Compound (51) | — | O | 3.8 | 100 | 0.147 | 100 | 0.03 | 0.155 |
| 47 | Compound (53) | — | O | 4.4 | 100 | 0.149 | 100 | 0.03 | 0.151 |
| 48 | Compound (54) | — | O | 3.9 | 95 | 0.150 | 90 | 0.04 | 0.150 |
| 49 | Compound (56) | — | O | 3.6 | 100 | 0.145 | 100 | 0.03 | 0.147 |
| 50 | Compound (51) | O | — | 3.8 | 95 | 0.146 | 90 | 0.02 | 0.147 |
| 51 | Compound (51) | O | O | 3.8 (for each bath) | 95 | 0.145 | 90 | 0.02 | 0.147 |
| 52 | Compound (53) | O | — | 4.4 | 95 | 0.149 | 90 | 0.03 | 0.150 |
| 53 | Compound (53) | O | O | 4.4 (for each bath) | 95 | 0.148 | 90 | 0.03 | 0.151 |
| 54 | Compound (54) | O | — | 3.9 | 100 | 0.148 | 95 | 0.02 | 0.150 |
| 55 | Compound (54) | O | O | 3.9 (for each bath) | 100 | 0.146 | 95 | 0.02 | 0.149 |
| 56 | Compound (56) | O | — | 3.6 | 95 | 0.145 | 90 | 0.03 | 0.148 |
| 57 | Compound (56) | O | O | 3.6 (for each bath) | 95 | 0.145 | 90 | 0.03 | 0.147 |

As is clear from the results shown in Table 3, the test samples of this invention are wholly excellent in sensitivity, the prevention of fog, the prevention of residual color, etc., and the invention is suitable of very quick processing.

Also, it can be seen that the processing time can be reduced to ½ of a conventional 90 second processing with reduced residual color while keeping a high sensitivity as compared with the conventional system, that is, the processing faculty of this invention is 2 times higher than that in the conventional system.

EXAMPLE 6

A silver halide emulsion composed of silver chlorobromide (5 mol % silver bromide, mean grain size 0.25 μm) containing $1\times10^{-5}$ mol of Rh per mol of silver was prepared.

To the emulsion was added 500 mg/mol-Ag of anhydro-5,5'-dichloro-9-ethyl-3,3'-di(3-sulfopropyl)oxacarbocyanine hydroxide sodium salt as a sensitizing dye. Furthermore, to the emulsion were added 2-hydroxy-4,6-dichloro-1,3,5-triazine sodium as a hardening agent and potassium polystyrenesulfonate as a thickener and then the emulsion was coated on a polyethylene terephthalate film at a silver coverage of 4 g/m$^2$. Also, an aqueous gelatin solution was coated on the emulsion layer as a protective layer at a gelatin coverage of 1.0 g/m$^2$. For the protective layer were used sodium p-dodecylbenzenesulfonate as a coating aid and the thickener as in the emulsion layer.

The sample thus obtained was exposed through an optical wedge using a printer P-607 Type (made by Dainippon Screen Mfg. Co., Ltd.) and then processed using the following developer and fix solution.

Developer

Developer LD-8-35 (trade name, made by Fuji Photo Film Co., Ltd.), 38° C., 20 seconds.

Fix Solution

Fix solution, LF 308 (trade name, made by Fuji Photo Film Co., Ltd.) added with the additive shown in Table 4.

Automatic Processor

FG-800 RA (trade name, made by Fuji Photo Film Co., Ltd.)

The residual color of each case after processing was determined and the results are shown in Table 4.

TABLE 4

| Compound Added to Fix Solution | Addition Amount (g/l) | Residual Color after Processing (transmitted optical density) |
|---|---|---|
| Control | — | 0.211 |
| Comparison Compound (a) | 7.9 | 0.212 |
| Comparison Compound (b) | 0.6 | 0.193 |
| Compound (2) | 1.3 | 0.167 |
| Compound (3) | 0.84 | 0.168 |
| Compound (6) | 1.5 | 0.167 |
| Compound (8) | 1.8 | 0.150 |
| Compound (11) | 2.5 | 0.149 |
| Compound (15) | 1.9 | 0.163 |
| Compound (16) | 2.7 | 0.165 |
| Compound (17) | 2.0 | 0.151 |
| Compound (21) | 2.1 | 0.148 |
| Compound (24) | 2.9 | 0.148 |
| Compound (35) | 1.7 | 0.158 |
| Compound (36) | 1.5 | 0.156 |
| Compound (37) | 1.8 | 0.159 |
| Compound (44) | 2.0 | 0.155 |
| Compound (51) | 1.3 | 0.161 |
| Compound (53) | 0.84 | 0.163 |
| Compound (54) | 1.5 | 0.163 |
| Compound (56) | 1.8 | 0.159 |

As is clear from the above results, in the case of processing the fix solution containing the compound defined in this invention, the occurrence of residual color after processing is less.

While the invention has been described in detail and with reference to specific embodiments thereof, it will be apparent to one skilled in the art that various changes and modifications can be made therein without departing from the spirit and scope thereof.

What is claimed is:

1. A process for processing a silver halide black and white photographic material, which comprises processing, after imagewise exposing, a silver halide black and white photographic material spectrally sensitized by a sensitizing dye with a processing solution containing at least one compound satisfying the following condition 1 and/or a salt thereof in an amount of at least $5\times10^{-5}$ mol/liter;

Condition 1:

when 4 ml of an aqueous solution of $8.0\times10^{-2}$ mol/liter of the compound is added to a mixture of 2 ml of an aqueous solution of $4.0\times10^{-4}$ mol/liter of anhydro-5,5'-dichloro-9-ethyl-3,3'-bis(3-sulfopropyl)thiacarbocyanine hydroxide.-pyridinium salt and 1 ml of an aqueous solution of $1.0\times10^{-1}$ mol/liter of potassium chloride and the resultant solution is diluted with water to 10 ml, the molecular extinction coefficient of the aqueous solution at 624 nm is not higher than $1.0\times10^{5}$.

2. The process for processing the silver halide black and white photographic material as claimed in claim 1, wherein the processing solution containing the compound is a developer.

3. The process for processing the silver halide black and white photographic material as claimed in claim 1, wherein the processing solution containing the compound is a fix solution.

4. The process for processing the silver halide black and white photographic material as claimed in claim 1, wherein the processing solution containing the compound is wash water or a stabilization solution.

5. The process for processing the silver halide black and white photographic material as claimed in claim 1, wherein the total processing time from development to drying is not longer than 90 seconds.

6. The process for processing the silver halide black and white photographic material as claimed in claim 1, wherein the amount of the compound in the processing solution is from $5\times10^{-5}$ mol/liter to $10^{-1}$ mol/liter.

7. The process for processing the silver halide black and white photographic material as claimed in claim 1, wherein the compound has a molecular weight of not more than 1,000.

8. The process for processing the silver halide black and white photographic material as claimed in claim 1, wherein the compound has a molecular weight of not more than 600.

* * * * *